US007629953B2

(12) United States Patent
Fukui

(10) Patent No.: US 7,629,953 B2
(45) Date of Patent: Dec. 8, 2009

(54) LIQUID CRYSTAL DEVICE, DRIVING METHOD THEREOF, AND ELECTRONIC APPARATUS

(75) Inventor: Kosuke Fukui, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 612 days.

(21) Appl. No.: 11/380,137

(22) Filed: Apr. 25, 2006

(65) Prior Publication Data

US 2006/0244701 A1 Nov. 2, 2006

(30) Foreign Application Priority Data

Apr. 27, 2005 (JP) ..... 2005-129419
Mar. 23, 2006 (JP) ..... 2006-080650

(51) Int. Cl.
*G09G 3/36* (2006.01)

(52) U.S. Cl. ..... 345/89; 349/33; 349/34; 349/35; 349/36; 349/37

(58) Field of Classification Search ..... None
See application file for complete search history.

(56) References Cited

U.S. PATENT DOCUMENTS 6,069,620 A * 5/2000 Nakamura et al. ..... 345/214
2003/0011555 A1* 1/2003 Fukami et al. ..... 345/94
2003/0090449 A1* 5/2003 Arimoto et al. ..... 345/87
2003/0122767 A1 7/2003 Nakao et al.
2005/0146664 A1* 7/2005 Hanaoka et al. ..... 349/130
2006/0092111 A1* 5/2006 Nakao et al. ..... 345/87

FOREIGN PATENT DOCUMENTS

JP A 2002-328399 11/2002
JP A 2002-357808 12/2002
KR 1020040057812 A 7/2004

* cited by examiner

*Primary Examiner*—Alexander Eisen
*Assistant Examiner*—Matthew Yeung
(74) *Attorney, Agent, or Firm*—Oliff & Berridge, PLC

(57) ABSTRACT

An OCB-mode liquid crystal device includes a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying an equal voltage to a plurality of pixel electrodes corresponding to an arbitrary first row, and of applying, to two pixel electrodes adjacent to both sides of one arbitrary pixel electrode among a plurality of pixel electrodes in a second row adjacent to the first row in a column direction, both voltages which are higher than or lower than an applied voltage to the one pixel electrode is performed on at least some of the plurality of pixel electrodes arrayed in a matrix. Differences between at least some of voltages applied in the voltage application operation and the voltage of an electrode formed in the other substrate of the pair of substrates are more than a threshold voltage required for the transfer to the bend alignment from the spray alignment.

13 Claims, 15 Drawing Sheets

LIQUID CRYSTAL DEVICE, DRIVING METHOD THEREOF, AND ELECTRONIC APPARATUS

BACKGROUND

1. Technical Field

The present invention relates to a liquid crystal device, a driving method thereof, and an electronic apparatus, and more specifically, to a liquid crystal device of an OCB (Optical Compensated Birefringence) mode.

2. Related Art

In the field of liquid crystal devices represented by, particularly, liquid crystal televisions, etc., OCB-mode liquid crystals device with rapid response speed for the purpose of the improvement in image quality of dynamic images has been highlighted in recent years. In the OCB mode, liquid crystal molecules in an initial state are in spray alignment in which the molecules are developed in a spray between two substrates, and liquid crystal molecules are required to be bent in the shape of a bow during display operation (bend alignment). This is for modulating transmittance according to the degree of bend of the bend alignment during display operation. Since liquid crystal assumes the spray alignment in its initial state during power cutoff in the case of the OCB-mode liquid crystal device, it requires a so-called initial transfer operation in which an aligned state of liquid crystal is transferred to the bend alignment during display operation from initial spray alignment by applying a voltage more than a threshold voltage in power-up to liquid crystal. Here, since poor display occurs or desired high-speed responsiveness cannot be obtained unless the initial transfer is sufficiently performed, the techniques disclosed in JP A-2002-328399 and JP A-2002-357808 have been suggested to solve these points.

In JP A-2002-328399 and JP A-2002-357808, voltages having polarities reverse to each other are applied to a pixel electrode and a pixel electrode (or a pixel electrode and wiring) adjacent to each other (dot inversion driving) to generate a horizontal electric field therebetween, thereby causing disclination liquid crystal. This facilitates generation of transfer nuclei in liquid crystal, allowing transfer to the bend alignment at high speed. Since this method uses right-and-left rotation of liquid crystal molecules by the horizontal electric field for generation of transfer nuclei, it is important to control the rotating direction of liquid crystal molecules. Thus, for example, in JP A-2002-357808, a horizontal electric field is generated between adjacent pixel electrodes, and the shape of pixel electrodes is contrived by providing a projection at the edges of the pixel electrodes to rotate the rotating direction.

However, it cannot still be said that the transfer to the bend alignment is at a sufficiently high speed only by applying voltages having reverse polarities between adjacent pixel electrodes likes for example, the dot inversion driving, but realization of the initial transfer indispensable to the OCB mode at higher speed are desired. Moreover, when the shape of pixel electrodes is changed like JP A-2002-357808, there is a possibility that defects, such as a decrease in numerical aperture or poor alignment of liquid crystal molecules, may occur. Particularly when the area of pixels becomes small, these problems will appear conspicuously.

SUMMARY

An advantage of the invention is that it provides a liquid crystal device and a driving method thereof which can realize initial transfer at higher speed compared with a case where dot inversion driving is performed, without particularly contriving the shape of pixel electrodes. Moreover, an advantage of the invention is that it provides an electronic apparatus allowing a display with excellent visibility of dynamic images by including such a liquid crystal device.

According to an aspect of the invention, there is provided an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying an equal voltage to a plurality of pixel electrodes corresponding to an arbitrary first row, and of applying, to two pixel electrodes adjacent to both sides of one arbitrary pixel electrode among a plurality of pixel electrodes in a second row adjacent to the first row in a column direction, both voltages which are higher than or lower than an applied voltage to the one pixel electrode is performed on at least some of the plurality of pixel electrodes arrayed in a matrix. Differences between at least some of voltages applied in the voltage application operation and the voltage of an electrode formed in the other substrate of the pair of substrates are more than a threshold voltage required for the transfer to the bend alignment from the spray alignment.

According to another aspect of the invention, there is provided an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying voltages to four pixel electrodes composed of two rows adjacent to each other and two columns adjacent to each other is performed on a plurality of pixel electrodes corresponding to at least a portion of a display region such that, when pixel electrodes located in the same column with two pixel electrodes in a first row and two pixel electrodes in a second row are compared, voltages which are higher or lower than both applied voltages to the pixel electrodes in the first row are applied to the pixel electrodes in the second row, and when pixel electrodes located in the same row with two pixel electrodes in a first column and two pixel electrodes in a second column are compared, voltages which are higher or lower than both applied voltages to the pixel electrodes in the first column are applied to the pixel electrodes in the second column. Differences between at least some of voltages applied in the voltage application operation and the voltage of an electrode formed in the other substrate of the pair of substrates are more than a threshold voltage required for the transfer to the bend alignment from the spray alignment.

According to a still another aspect of the invention, there is provided an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying voltages to four pixel electrodes composed of two rows adjacent to each other and two columns adjacent to each other is performed on a plurality of pixel electrodes corresponding to at least a portion of a display region such that, when pixel electrodes located in the same column with two pixel electrodes in a first row and two pixel electrodes in a second row are compared, voltages which are higher than an applied voltage to a pixel electrode in the first low located in one column and lower than an applied voltage to a pixel electrode in the first row located in the other column are applied to the pixel electrodes in the second row, and when pixel electrodes located in the same row with two pixel electrodes in a first column and two pixel electrodes in a second column are compared, voltages which are higher or lower than both applied voltages to the pixel electrodes in the first column are applied to the pixel electrodes in the second column. Differences between at least some of voltages applied in the voltage application operation and the voltage of an electrode formed in the other substrate of the pair of substrates are more than a threshold voltage required for the transfer to the bend alignment from the spray alignment.

In addition, in the liquid crystal device according to the above aspects of the invention, preferably, the voltage between at least a set of pixel electrodes generates a region in which the rotating directions of the liquid crystal molecules differ from each other, and causes disclination at a boundary between the regions.

Several methods as described above have already been suggested about the initial transfer in the OCB mode, and when liquid crystal molecules transfers to the bend alignment from the spray alignment, it is known that the transfer proceeds smoothly via twist alignment. In particular, the twist of 90° or more is preferable. As one of the above methods, there is a method of generating two kinds of clockwise and counterclockwise regions which are different in the rotating direction of liquid crystal molecules, and making a twist of 90° or more at a boundary between the regions to generate disclination. Also, the alignment of liquid crystal molecules changes from the spray alignment to the bend alignment, with one the regions to which more than a threshold voltage required for the transfer is applied being a starting point (this is called transfer nucleus). This is also widely known already.

Although the invention will be described in detail in the following section "Best Mode for Carrying Out the Invention", the inventors have ascertained that, although two regions where the rotating directions of liquid crystal molecules differ from each other are created still in the dot inversion driving that is an initial transfer method of related art, a region where the rotating direction of liquid crystal molecules is not defined may be created simultaneously with creation of the above two formation, and this region becomes a cause of delaying an alignment change to the bend alignment from the spray alignment. In contrast in the invention, if a voltage application operation which applies voltages with size relation as described above is performed on a plurality of adjacent pixel electrodes among a plurality of pixels arrayed in a matrix, any region where the rotating direction of liquid crystal molecules is not defined like the dot inversion driving will be created. Accordingly, the initial transfer can be smoothly performed by a transfer nucleus created at a boundary between two regions where the rotating directions of liquid crystal molecules differ from each other, and the time required for the initial transfer can be shortened. The more detailed operations of the invention will also be described below.

In the above aspects of the invention, it is preferable that all the voltages applied in the voltage application operation be more than the threshold voltage.

A voltage (threshold voltage) above a certain fixed value is required for the transfer to the bend alignment from the spray alignment of liquid crystal. As long as some of a plurality of voltages applied to a plurality of pixel electrodes exceeds a threshold voltage at the time of initial transfer, transfer nuclei are generated in portions with such voltages, the transfer propagate from there, and bend alignment spreads to the whole. However, the greater the dependency on the propagation of transfer, the speed until the whole display region reaches initial transfer becomes slower. Accordingly, if all the voltages applied in the voltage application operation are more than a threshold voltages the advantages of the invention can be utilized to the maximum, and the time required for the initial transfer can be further shortened.

Moreover, it is desirable that the voltage application operation is performed on all the plurality of pixel electrodes in the display region.

As described above, if the voltage application operation unique to the invention is applied to a plurality of pixel electrodes in some regions in the display region, the whole display region can be shifted to initial transfer by propagation of transfer, but the speed of the initial transfer becomes slow. Thus, if the voltage application operation is performed on all the plurality of pixel electrodes in the display region, the time required for the initial transfer can be further shortened.

Moreover, the liquid crystal device according to the latter two aspects of the three aspects of the invention may adopt a configuration in which, in the voltage application operation, voltages having reverse polarities with respect to a predetermined reference potential are applied to the pixel electrodes in the first row and the pixel electrodes in the second row, and the polarity of a voltage applied to the pixel electrodes in each row is reversed for every unit time. Moreover, the liquid crystal device according to all the three aspects of the invention may adopt a configuration in which, in the voltage application operation, voltages having the same polarity with respect to with respect to a predetermined reference potential are applied to the pixel electrodes in the first row and the pixel electrodes in the second row, and the polarity of a voltage applied to the pixel electrodes in each row is reversed for every unit time.

That is, the former configuration is called line inversion driving, and the latter configuration is called frame inversion driving. Specifically, the voltage application operation of the invention can be implemented by performing these line inversion driving and frame inversion driving.

Moreover, in the liquid crystal device according to the three aspects of the invention, preferably, a voltage according to a gray-scale with respect to a predetermined reference potential is applied to each of the plurality of pixel electrodes after the voltage application operation during the transfer.

According to a still another aspect of the invention, there is provided an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying an equal voltage to a plurality of pixel electrodes in an arbitrary first row, and of applying voltages to a second row adjacent to the first row in a column direction such that pixel electrodes each having an equipotential line which goes around itself appear alternately is performed on a plurality of pixel electrodes corresponding to at least a portion of a display region. Differences between at least some of voltages applied in the voltage application operation and the voltage of an electrode formed in the other substrate of the pair of substrates are more than a threshold voltage required for the transfer to the bend alignment from the spray alignment.

According to a still another aspect of the invention, there is provided an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying different voltages to a plurality of pixel electrodes in one row for all rows, and of applying voltages such that pixel electrodes each having an equipotential line which goes around itself appear alternately in the same row and pixel electrodes each having an equipotential line which goes around itself appear alternately in the same column is performed on a plurality of pixel electrodes corresponding to at least a portion of a display region. Differences between at least some of voltages applied in the voltage application operation and the voltage of an electrode formed in the other substrate of the pair of substrates are more than a threshold voltage required for the transfer to the bend alignment from the spray alignment.

According to a still another aspect of the invention, there is provided an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying different voltages to a plurality of pixel electrodes in one row for all rows, and of applying voltages such that rows in which all the pixel electrodes in one row have an equipotential line which goes around themselves and rows in which all the pixel electrodes in one row have no equipotential line which goes around themselves appear alternately, is performed on a plurality of pixel electrodes corresponding to at least a portion of a display region. Differences between at least some of voltages applied in the voltage application operation and the voltage of an electrode formed in the other substrate of the pair of substrates are more than a threshold voltage required for the transfer to the bend alignment from the spray alignment.

In addition, in the liquid crystal device according to the above three aspects of the invention, preferably, the voltage between at least a set of pixel electrodes generates a region in which the rotating directions of the liquid crystal molecules differ from each other, and causes disclination at a boundary between the regions.

The liquid crystal device of the invention described previously is expressed by the size relation of applied voltages to adjacent pixel electrodes, whereas the liquid crystal device according to the above three aspects of the invention is expressed in the shape of equipotential lines, and their substantial operations are completely the same. Accordingly, the liquid crystal device according to the aspects of the invention also has advantages that the speed of the initial transfer becomes rapid, and the time required for the initial transfer can be shortened.

According to a still another aspect of the invention, there is provided a method of driving an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying an equal voltage to a plurality of pixel electrodes corresponding to an arbitrary first row, and of applying, to two pixel electrodes adjacent to both sides of one arbitrary pixel electrode among a plurality of pixel electrodes in a second row adjacent to the first row in a column direction, both voltages which are higher than or lower than an applied voltage to the one pixel electrode is performed on at least some of the plurality of pixel electrodes arrayed in a matrix. Differences between at least some of voltages applied in the voltage application operation and the voltage of an electrode formed in the other substrate of the pair of substrates are set to be more than a threshold voltage required for the transfer to the bend alignment from the spray alignment.

According to a still another aspect of the invention, there is provided a method of driving an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying voltages to four pixel electrodes composed of two rows adjacent to each other and two columns adjacent to each other is performed on a plurality of pixel electrodes corresponding to at least a portion of a display region such that, when pixel electrodes located in the same column with two pixel electrodes in a first row and two pixel electrodes in a second row are compared, voltages which are higher or lower than both applied voltages to the pixel electrodes in the first row are applied to the pixel electrodes in the second row, and when pixel electrodes located in the same row with two pixel electrodes in a first column and two pixel electrodes in a second column are compared, voltages which are higher or lower than both applied voltages to the pixel electrodes in the first column are applied to the pixel electrodes in the second column. Differences between at least some of voltages applied in the voltage application operation and the voltage of an electrode formed in the other substrate of the pair of substrates are set to be more than a threshold voltage required for the transfer to the bend alignment from the spray alignment.

According to a still another aspect of the invention, there is provided a method of driving an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display. During the transfer, a voltage application operation of applying voltages to four pixel electrodes composed of two rows adjacent to each other and two columns adjacent to each other is performed on a plurality of pixel electrodes corresponding to at least a portion of a display region such that, when pixel electrodes located in the same column with two pixel electrodes in a first row and two pixel electrodes in a second row are compared, voltages which are higher than an applied voltage to a pixel electrode in the first low located in one column and lower than an applied voltage to a pixel electrode in the first row located in the other column are applied to the pixel electrodes in the second row, and when pixel electrodes located in the same row with two pixel electrodes in a first column and two pixel electrodes in a second column are compared, voltages which are higher or lower than both applied voltages to the pixel electrodes in the first column are applied to the pixel electrodes in the second column. Differences between at least some of voltages applied in the voltage application operation and the voltage of an electrode formed in the other substrate of the pair of substrates are set to be more than a threshold voltage required for the transfer to the bend alignment from the spray alignment.

In addition, in the liquid crystal device according to the above three aspects of the invention, preferably, the voltage between at least a set of pixel electrodes generates a region in which the rotating directions of the liquid crystal molecules differ from each other, and causes disclination at a boundary between the regions.

According to the driving method of the liquid crystal device according to the above aspects of the invention, since a region where the rotating directions of liquid crystal molecules is not defined is not created, the initial transfer can be smoothly performed by a transfer nucleus created at a boundary between two regions where the rotating directions of liquid crystal molecules differ from each other. Accordingly, the speed of the initial transfer becomes rapid, and the time required for the initial transfer can be shortened.

Moreover, according to a still another aspect of the invention, an electronic apparatus includes the liquid crystal device according to the above aspects of the invention. According to this aspect of the invention, since the apparatus includes the liquid crystal device according to any one of the above aspects of the invention, an electronic apparatus allowing a display with excellent visibility of dynamic images can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

First Embodiment

First, a liquid crystal device according to a first embodiment of the invention will be described.

The liquid crystal device according to the first embodiment is an active matrix type display device which uses a thin film transistor (hereinafter referred to as "TFT") as a pixel switching element.

Figure 1:
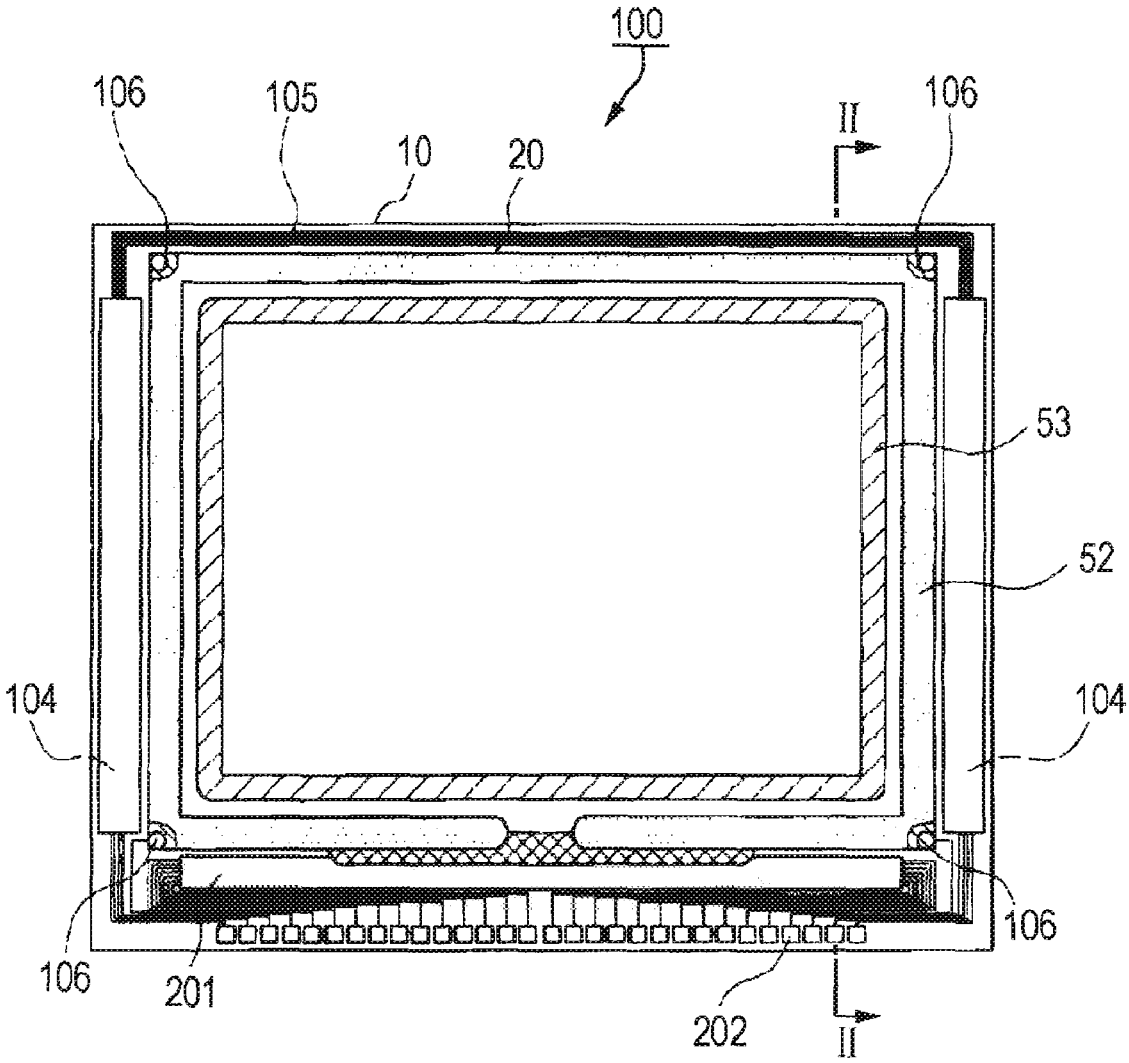
FIG. 1 is a plan view of a liquid crystal device according to a first embodiment.
Figure 2:
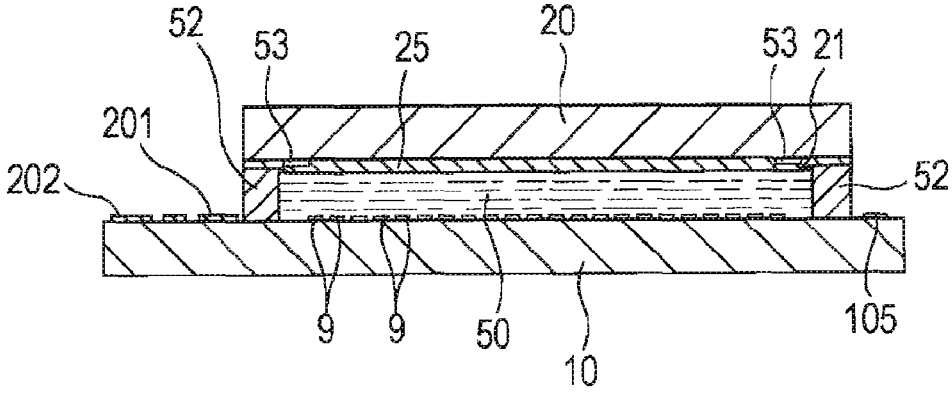
FIG. 2 is a sectional view taken along the line H-H' of FIG. 1.

FIG. 1 is a plan view of the liquid crystal device along with their individual components when they are viewed from the counter substrate side, and FIG. 2 is a sectional view broken along the H-H' line in FIG. 1. In addition, scales of individual layers and members in FIGS. 1 and 2 are made different from each other so that the individual layers and members have recognizable sizes in the drawings.

As shown in FIGS. 1 and 2, the liquid crystal device 100 according to this embodiment is configured such that a TFT array substrate 10 and a counter substrate 20 are bonded together by a sealant 52, and liquid crystal 50 is enclosed in a region which is partitioned off by this sealant 52. The liquid crystal 50 has a positive dielectric anisotropy, and is in an OCB mode which assumes spray alignment in an initial state, and assumes bend alignment during display operation.

A light-shielding film (peripheral partition) 53 made of a light-shielding material is formed in a region inside the sealant 52. A data line driving circuit 201 and an external circuit mounting terminal 202 are formed in a peripheral circuit region outside the sealant 52 along one side of the TFT array substrate 10, and scanning line driving circuits 104 are formed in regions along two sides adjacent to this one side. A plurality of wiring lines 105 for connecting the scanning line driving circuits 104 provided on both sides of a display region 40 with each other are formed in the remaining one side of the TFT array substrate 10. Moreover, electrical connection materials 106 for establishing electrical connection between the TFT array substrate 10 and the counter substrate 20 are disposed in at least two corners of the counter substrate 20.

Figure 3:
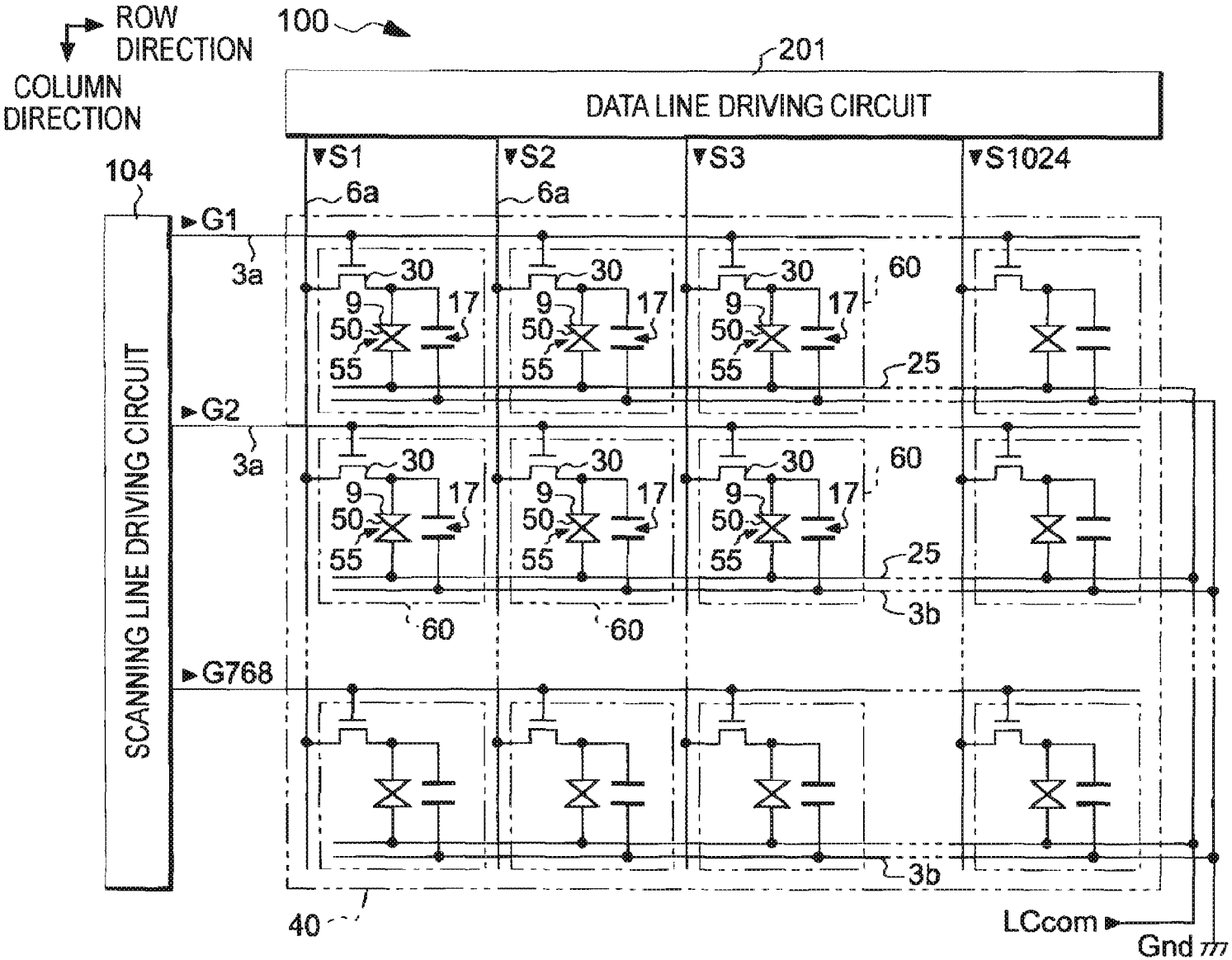
FIG. 3 is a block diagram showing a circuit configuration of the liquid crystal device.

FIG. 3 is a view showing the electrical configuration of the liquid crystal device 100.

As shown in this drawing, in this embodiment, scanning lines 3*a* of 768 rows extend in the horizontal direction in the drawing, respectively, while data lines 6*a* of 1024 columns extend in the vertical direction in the drawing. The pixels 60 are provided corresponding to the intersections, respectively, of the scanning lines 3*a* and the data lines 6*a*. Accordingly, in this embodiment, the pixels 60 are arrayed in a matrix of 768 rows×1024 columns. In this way, a region in which the pixels 60 are arrayed in a matrix is the display region 40.

in addition, in this embodiment, the horizontal direction in which the scanning lines 3*a* extend and the vertical direction in which the data lines 6*a* extends are referred to as "row direction" and "column direction," respectively, for convenience.

In each pixel 60, the source of an n-channel-type TFT 30 is connected to each data line 6*a*, the drain thereof is connected to each of pixel electrode 9, and the gate thereof is connected to each scanning line 3*a*. The pixel electrodes 9, as shown in FIG. 2, are formed on the TFT array substrate 10, while a common electrode 25 is formed on the counter substrate 20 so as to face all the pixel electrodes 9. Therefore, a liquid crystal capacitor 55 in which the liquid crystal 50 is interposed between the pixel electrodes 9 and the common electrode 25 is constructed in every pixel 60.

Meanwhile, aligned films (not shown) are formed on the facing surfaces, respectively, of the TFT array substrate 10 and the counter substrate 20, and in this embodiment, both the aligned films are subjected to rubbing processing in the row direction. Therefore, each of the major axes of liquid crystal molecules located in the vicinity of the aligned films of the substrate surfaces is aligned along the row direction. On the other hand, in order to align the liquid crystal molecules located in the vicinity of an intermediate area between the substrates so that they may maintain continuity with the liquid crystal molecules located in the vicinity of the aligned films of the substrate surfaces in a state where no voltage is applied, the liquid crystal molecules are aligned along the row direction In plan view, and they are aligned substantially in parallel with the direction along the substrate surface in sectional view (spray alignment). It is assumed in a display mode as will be described below that liquid crystal molecules are in a state (bend alignment) where they are aligned in an arched symmetrical shape from the TFT array substrate 10 to the counter substrate 20, that is, they are aligned in a direction vertical to the substrate surface toward the center between the substrates. Therefore, when the liquid crystal in the OCB mode is used, it is necessary to transfer liquid crystal molecules to the bend alignment from the spray alignment in an initial state.

In this embodiment, in a transfer mode as will be described below, liquid crystal molecules are efficiently transferred to the bend alignment from the spray alignment by applying a voltage in a predetermined pattern to each pixel electrode. The, after transfer to the bend alignment, if a voltage according to a gray-scale is applied to and held by the liquid crystal capacitor 55, the liquid crystal capacitor 55 will change in the quantity of transmitted light per unit time according to the effective value of the held voltage. Thereby the light which has entered liquid crystal is modulated, allowing a gray-scale display.

In addition, a constant voltage LCcom, which is constant in time, is applied to the common electrode 25 via the above-mentioned mounting terminal 202 and electrical connection materials 106. In this embodiment, the voltage LCcom is set to about 5 V.

Moreover, a storage capacitor 17 is provided in every pixel 60. This storage capacitor 17 is electrically interposed between the drain (pixel electrode 9) of the TFT 30, and a capacitance line 3*b* maintained at constant potential Gnd, for example, ground potential, so that it may become electrically in parallel with the liquid crystal capacitor 55.

The scanning line driving circuit 104 supplies scanning signals G1, G2, G3, . . . , and G768 to 1st, 2nd, 3rd, . . . , and 768th rows of scanning lines 3*a*, respectively. In addition, the scanning line driving circuits 104 are disposed on both sides of the display region 40 in FIG. 1. This is to prevent scanning signals from being delayed at one end and the other end of a scanning line. Therefore, from the electrical viewpoint, as shown in FIG. 3, this configuration is equivalent to a configuration in which one scanning line driving circuit is disposed on one side of the display region 40.

The data line driving circuit 201 supplies data signals S1, S2, S3, . . . , and S1024 to 1st, 2nd, 3rd, . . . , and 1024th columns of data lines 6*a*, respectively.

For the sake of convenience of description, the scanning signals supplied to three mutually adjacent (n+1)th, (n+2)th, and (n+3)th rows of scanning lines, respectively, among 1st, 2nd, 3rd, . . . , and 768th rows of scanning lines 3*a* are generally denoted by G (n+1), G (n+2), and G (n+3) rows. Here, in this embodiment, all of (n+1), (n+2), and (n+3) are integers ranging from 1 to 768.

Similarly, the data signals supplied to three mutually adjacent (m+1)th, (m+2)th, and (m+3)th columns of data lines, respectively, among 1st, 2nd, 3rd, . . . , and 768th columns of data lines 6*a* are generally denoted by S (m+1), G (m+2), and G (m+3) rows. Here, in this embodiment, all of (m+1), (m+2), and (m+3) are integers ranging from 1 to 1024.

Moreover, in the first embodiment, a row (line) inversion system in which the write-in polarity to a pixel electrode is reversed for every row corresponding to a scanning line will be described.

In addition, although the reference of a voltage is the ground potential Gnd in this embodiment, the reference of a write-in polarity is the voltage LCcom (=5 V) applied to the common electrode 25. In other words, in this embodiment, as far as data signals are concerned, a voltage higher than the voltage LCcom becomes a positive polarity, and a voltage lower than the voltage Lccom becomes a negative polarity. However, as will be described below, the voltage LCcom applied to the common electrode 25 may be set to a voltage different from the reference potential of a write-in polarity that is the center of the amplitude of a data signal.

Next, the operation of the liquid crystal device 100 will be described.

This liquid crystal device 100 performs its initial transfer operation as a transfer mode until a predetermined time has lapsed from immediately after power-on, and thereby transfers liquid crystal molecules to the bend alignment from the spray alignment, and proceeds to a display mode after an appropriate time to perform display operation.

Figure 4:
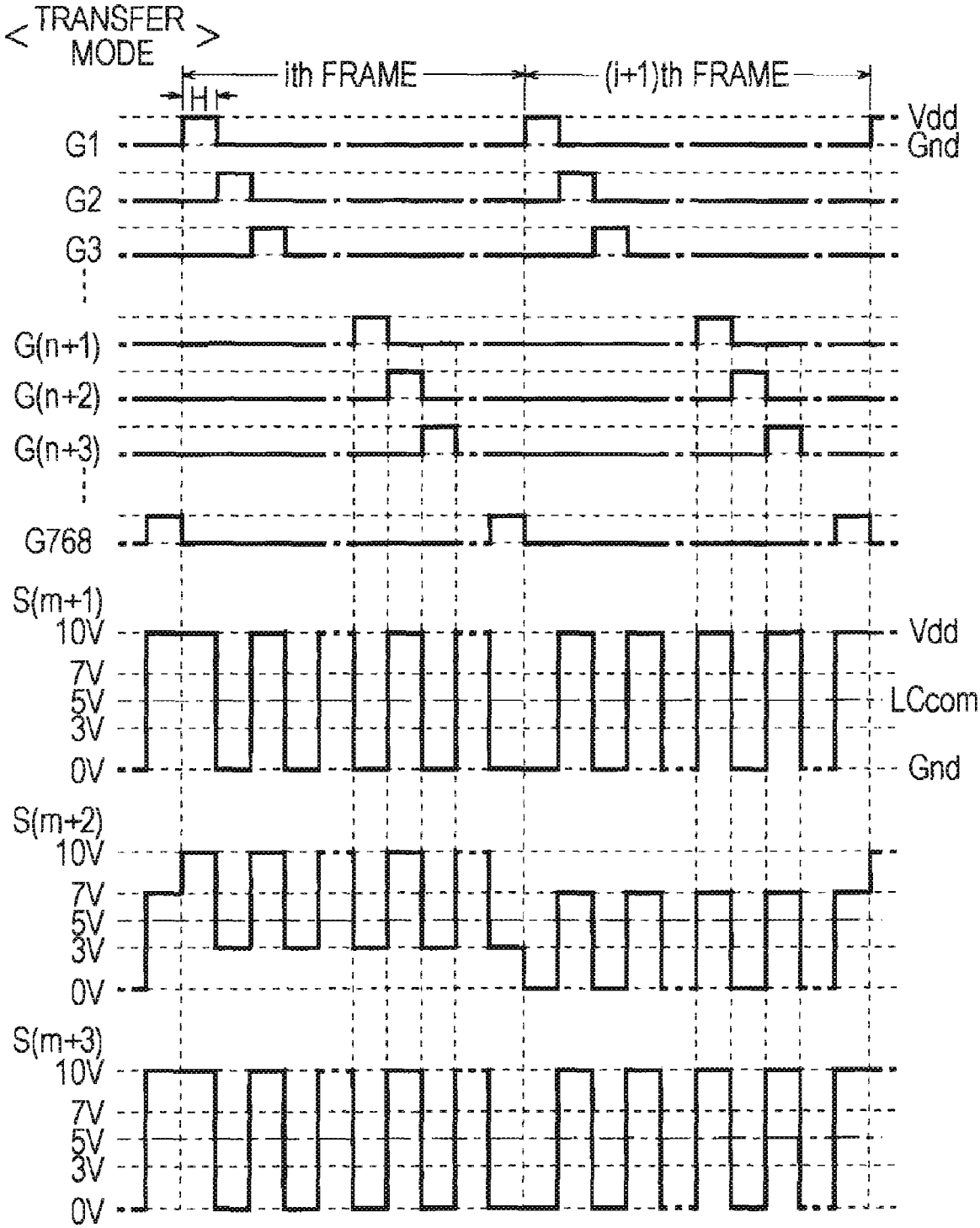
FIG. 4 is a view showing signal waveforms in a transfer mode of the liquid crystal device.

Thus, the transfer mode in the liquid crystal device 100 will first be described. In the transfer mode, as shown in FIG. 4, the scanning line driving circuit 104 sets the scanning signals G1, G2, G3, . . . , and G768 to an H level sequentially and exclusively in every horizontal scanning period H over each frame.

The data line driving circuit 201 first supplies the following data signals in the transfer mode. That is, in a certain frame (referred to as ith frame), the data line driving circuit 201 sets all the data signals to 10 V of positive polarity in the horizontal scanning period H in which a scanning line in a 1st row is selected and the scanning signal G1 is set to an H level. Here, since the TFTs 30 are in an electrical connection (ON) state in one row of pixels 60 corresponding to the scanning line 3*a* in the first low if the scanning signal G1 is set to an H level, the voltages of the data signals supplied to the data lines 6*a* are applied to the pixel electrodes 9. Therefore, the voltage of 10 V is applied to all of one row of pixel electrodes 9 of the 1st row of pixels. Since the applied voltage LCcom to the common electrode 25 which faces all the pixel electrodes 9 is 5 V which is constant in time, with the potential of the common electrode 25 as a reference, a voltage of +5 V is held in all of a 1st row of liquid crystal capacitors 55.

In addition, in FIG. 4, the voltage scale of the data signals in the longitudinal direction is larger than the voltage scale of the scanning signals (this is also true of similar drawings as will be described below).

Next, if the scanning signal G2 is set to an H level, the data line driving circuit 201 alternately applies 0 V and 3 V of negative polarity to the data lines 6*a* for every column so that the data signal S(m+1) may be set to 0 V, the data signal S(m+2) may be set to 3 V, and the data signal S(m+3) may be set 0 V. Therefore, since the voltages of 0 V and 3 V are alternately applied to one row of pixel electrodes 9 of a 2nd row of pixels for every column, voltages −5 V and −2 V are held alternately for every column in one row of liquid crystal capacitors 55 of the 2nd row of pixels.

Subsequently, if the scanning signal G3 is set to an H level, the data line driving circuit 201 sets all the data signals to 10 V of positive polarity similarly to the horizontal scanning period H when the scanning signal G1 is set to an H level. Thereby, the voltage of 10 V is applied to all the 3rd row of pixel electrodes 9, and the voltage of +5 V is held in the liquid crystal capacitors 55.

If the scanning signal G4 is set to an H level, the data line driving circuit 201 alternately applies 0 V and 3 V of negative polarity to the data lines 6*a* for every column similarly to the horizontal scanning period H when the scanning signal G2 is set to an H level. Thereby, the voltages of 0 V and 3 V are alternately applied to all the 4th row of pixel electrodes 9 for every column, and voltages −5 V and −2 V are held alternately for every column in the liquid crystal capacitors 55.

In this ith frame, the same operation as the above is repeated until the scanning signal G768 is set to an H level.

Accordingly, in the ith frame, the voltage of 10 V is applied to all of odd (1st, 3rd, 5th, . . . , and 767th) rows of pixel electrodes 9, while the voltages of 0 V and 3 V are alternately applied to even (2nd, 4th, 6th, . . . , and 768th) rows of pixel electrodes 9 for every column.

In the next (i+1)th frame, the scanning line driving circuit 104 also sets the scanning signals G1, G2, G3, . . . , and G768 to an H level sequentially and exclusively in every horizontal scanning period H. Moreover, the data line driving circuit 201 sets all the data signals to 0 V of negative polarity in the horizontal scanning period H when the scanning signal G1 is set to an H level. Thereby, the voltage of 0 V is applied to one row of pixel electrodes 9 in the first row of pixels, and the voltage of −5 V is held in the liquid crystal capacitors 55.

Subsequently, if the scanning signal G2 is set to an H level, the data line driving circuit 201 alternately applies 10 V and 7 V of positive polarity to the data lines 6*a* for every column so that the data signal S(m+1) may be set to 10 V, the data signal S(m+2) may be set to 7 V, and the data signal S(m+3) may be set 10 V. Thereby, the voltages of 10 V and 7 V are alternately applied to one row of pixel electrodes 9 in the second rows of pixels for every column, and voltages +5 V and +2 V are held alternately for every column in the liquid crystal capacitors 55.

In this (i+1)th frame, the same operation as the above is repeated until the scanning signal G768 is set to an H level.

Accordingly, in the (i+1)th frame, the voltage of 0 V is applied to all odd rows of pixel electrodes 9, while the voltages of 10 V and 7 V are alternately applied to even rows of pixel electrodes 9 for every column.

Therefore, in this embodiment, from the viewpoint the same pixel 60, if the voltages held in a liquid crystal capacitor 55 in the ith frame and the (i+1)th frame differ from each other only in terms of polarity, but they are the same in terms of their absolute values. Therefore, over multiple frames in the transfer mode, application of a direct-current component to each liquid crystal capacitor 55 is avoided, and deterioration of the liquid crystal 50 is prevented.

Furthermore, the absolute values of hold voltages in a liquid crystal capacitor to which 10 V or 0 V is applied to a pixel electrode 9 are 5 V, and the absolute values of hold voltages in a liquid crystal capacitor to which 3 V or 7 V is applied to a pixel electrode 9 are 2 V. The voltages of these absolute values are voltages which exceed a threshold voltage that is required for transferring the liquid crystal 50 enclosed between the TFT array substrate 10 and the counter substrate 20 to the bend alignment. Accordingly, according to this embodiment, in the transfer mode, the liquid crystal 50 sandwiched by the liquid crystal capacitors 55 transfers surely to the bend alignment.

Figure 5:
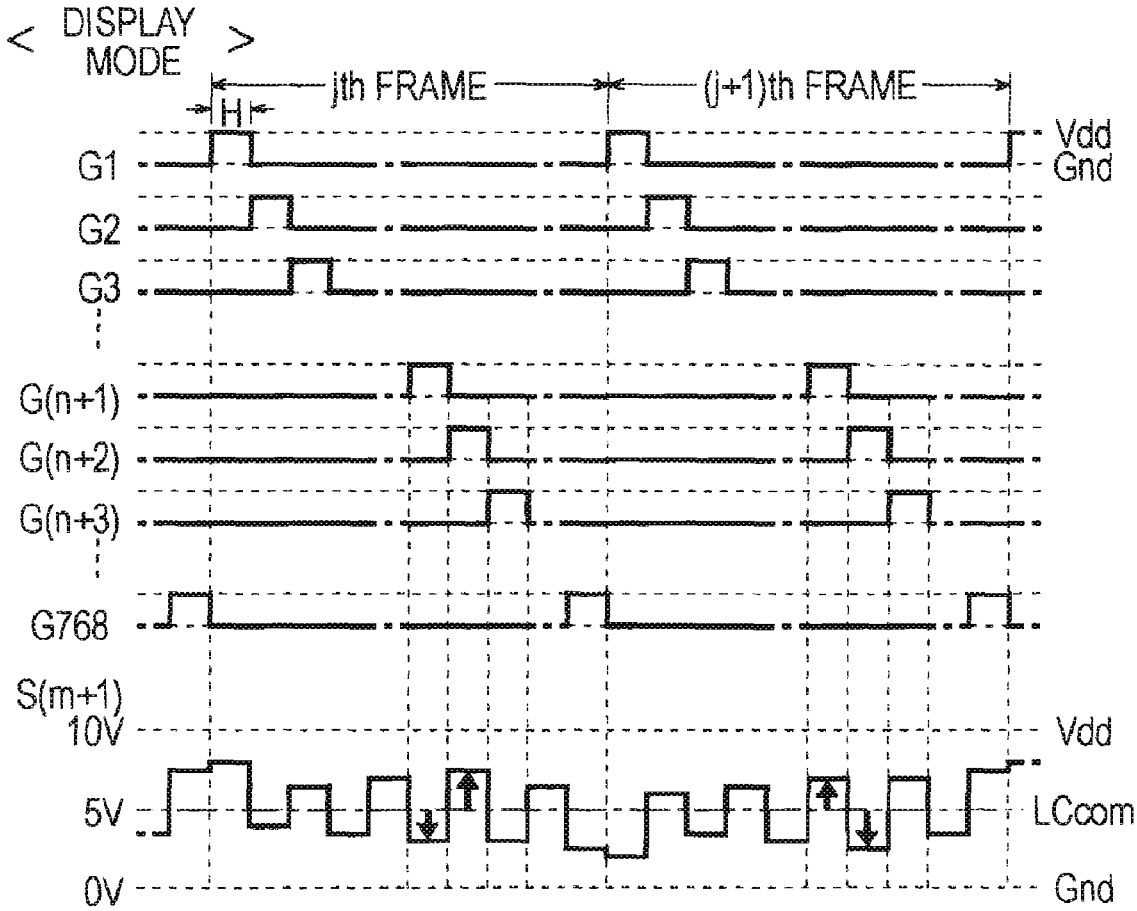
FIG. 5 is a view showing signal waveforms in a display mode of the liquid crystal device.

If a mode after transfer to the bend alignment by the transfer mode becomes a display mode, a voltage according to display contents is written in each pixel electrode. Specifically, as shown in FIG. 5, similar to the transfer mode, the scanning line driving circuit 104 sets the scanning signals G1, G2, G3, . . . , and G768 to an H level sequentially and exclusively in every horizontal scanning period H over each frame. In this case, the data line driving circuit 201 supplies data signals of voltages according to gray-scales to the pixels 60 corresponding to a scanning line 3*a* set to an H level.

For example, in a certain frame (referred to as ith frame), when the scanning signal G(n+1) is set to an H level, the data line driving circuit 201 sets the voltage of the data signal S(m+1) supplied to the data line 6*a* in an (m+1)th column to the voltage (↓ in the drawing) of negative polarity according to the gray-scale of a pixel corresponding to an intersection of the scanning line 3*a* in an (n+1)th row and the data line 6*a* in the (m+1)th column, and when the scanning signal G(n+2) is set to an H level, the data line driving circuit sets the above voltage to the voltage (↑ in the drawing) of positive polarity according to the gray-scale of a pixel corresponding to an intersection of the scanning line 3*a* in an (n+2)th row, and the data line 6*a* in the (m+1)th column. On the other hand, in the next (j+1)th frame, the data line driving circuit sets the above voltage to the voltage (↑ in the drawing) of positive polarity according to the gray-scale of a pixel corresponding to an intersection of the scanning line 3*a* in the (n+1)th row and the data line 6*a* in the (m+1)th column, and when the scanning signal G(n+2) is set to an H level, the data line driving circuit sets the above voltage to the voltage (↓ in the drawing) of negative polarity according to the gray-scale of a pixel corresponding to the intersection of the scanning line 3*a* in the (n+2)th row and the data line 6*a* in the (m+1)th column.

In addition, in FIG. 5, since the data signal S(m+1) supplied to the data line 6*a* in the (m+1)th column is described on behalf of the data signals, others are omitted herein.

Next, in this embodiment, the reason why the voltages of the data signals as shown in FIG. 4 are applied in the transfer mode will be described.

Figure 6:
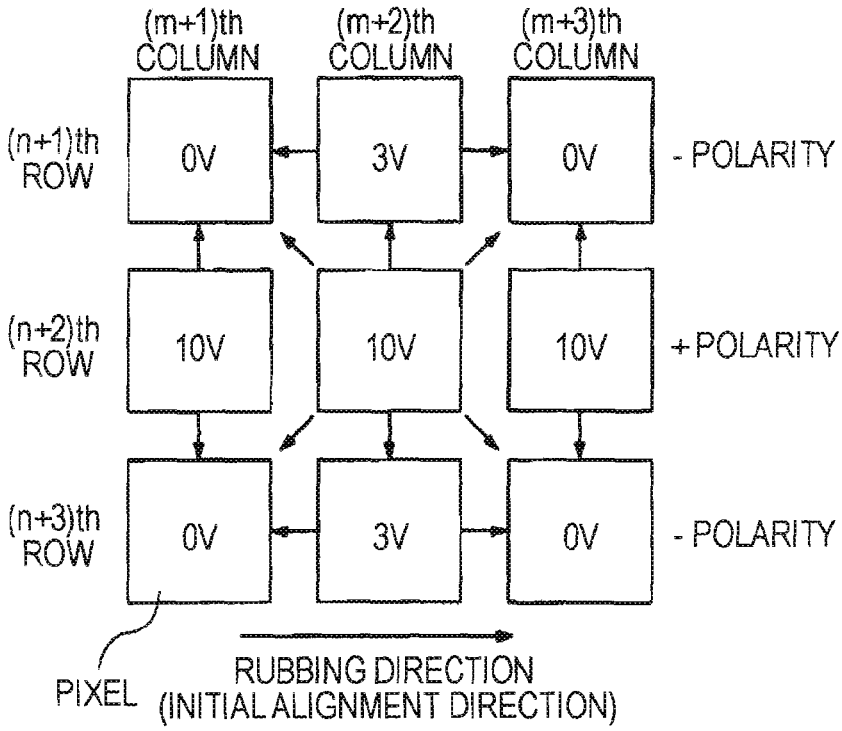
FIG. 6 is a view showing an applied voltage pattern to individual pixel electrodes in the transfer mode.

FIG. 6 is a view showing voltages applied in an ith frame to pixel electrodes 9 of a total of nine pixels 60 corresponding to intersections of three rows, i.e., an (n+1)th row, an (n+2)th row, and an (n+3)th row, and three columns, i.e., an (m+1)th column, an (m+2)th column, and an (m+3)th column.

That is, generally, voltages equal to each other are applied to all pixel electrodes in the (n+2)th row. Also, voltages are applied to a plurality of pixels in the (n+1)th row and (n+3)th row adjacent to the (n+2)th row such that both applied voltages to two pixel electrodes adjacent to both sides an arbitrary one pixel electrode in one row are higher than a voltage applied to the central one pixel electrode (with respect to a voltage electrode to which 0 V is applied, the voltages of both electrodes adjacent thereto are higher than 0 V), or are lower than the voltage applied to the central one pixel electrode (with respect to a pixel electrode to which 3 V is applied, both the voltages of pixel electrodes adjacent thereto are lower than 3 V).

At this time, potential differences occur among all the other pixel electrodes excluding between adjacent pixel electrodes in the (n+2)th row. Here, since the distance between pixel electrodes is narrower than the cell gap between the TFT array substrate 10 and the counter substrate 20, field intensity is stronger between the pixel electrode 9 than between the pixel electrodes 9 and the common electrode 25. Therefore, in this embodiment, since the field intensity between the pixel electrodes 9 is stronger than that in a case where a threshold voltage is applied between the pixel electrodes 9 and the common electrode 25, voltage differences occurring among all the other pixel electrodes except between adjacent pixel electrodes in the (n+2)th row is a voltage which rotates liquid crystal molecules in a plane, i.e., a voltage enough to cause disclination in boundary regions between the pixel electrodes.

In addition, in FIG. 6 and the following similar drawings, arrows are given between the pixel electrodes in which an electric field (potential difference) is generated, and, as for the direction of the arrows, the base end of each arrow indicates the high voltage side, and the tip end of the arrow indicates the low voltage side.

Figure 7:
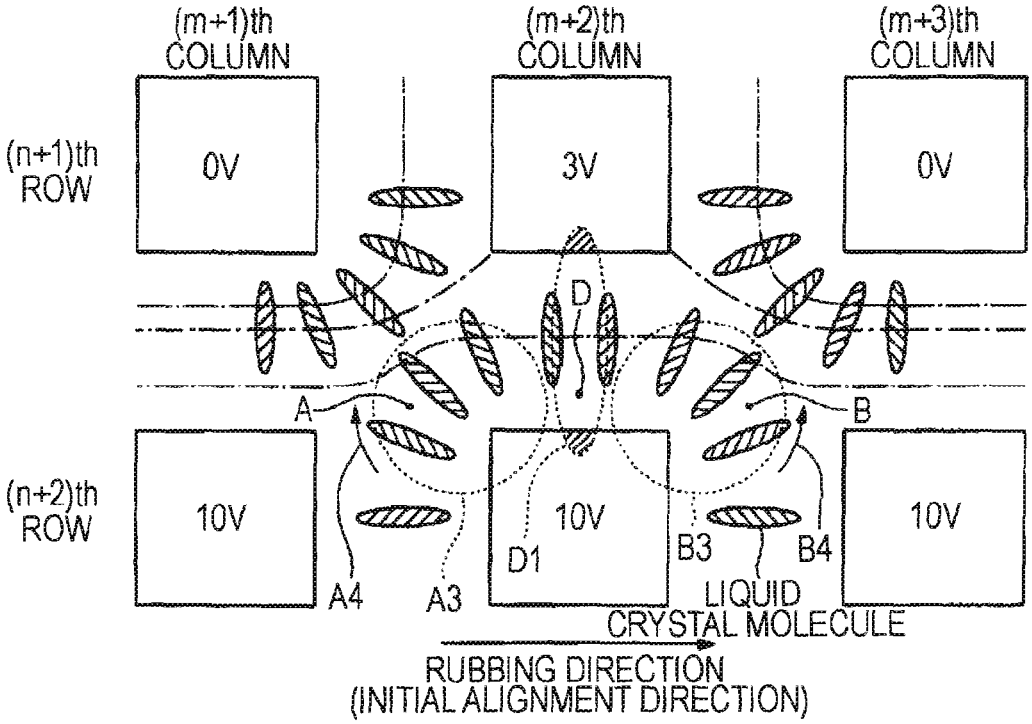
FIG. 7 is a view for explaining the behavior of liquid crystal molecules in the transfer mode.

FIG. 7 is a view for explaining a motion of liquid crystal molecules in vicinity of six pixel electrodes in the (n+1)th and (n+2)th rows in FIG. 6. Here, before the motion of the liquid crystal molecules is described referring to FIG. 7, the reason why sufficient high-speed responsiveness is not obtained when the dot inversion driving of related art is adopted as a comparative example will be discussed.

Figure 20:
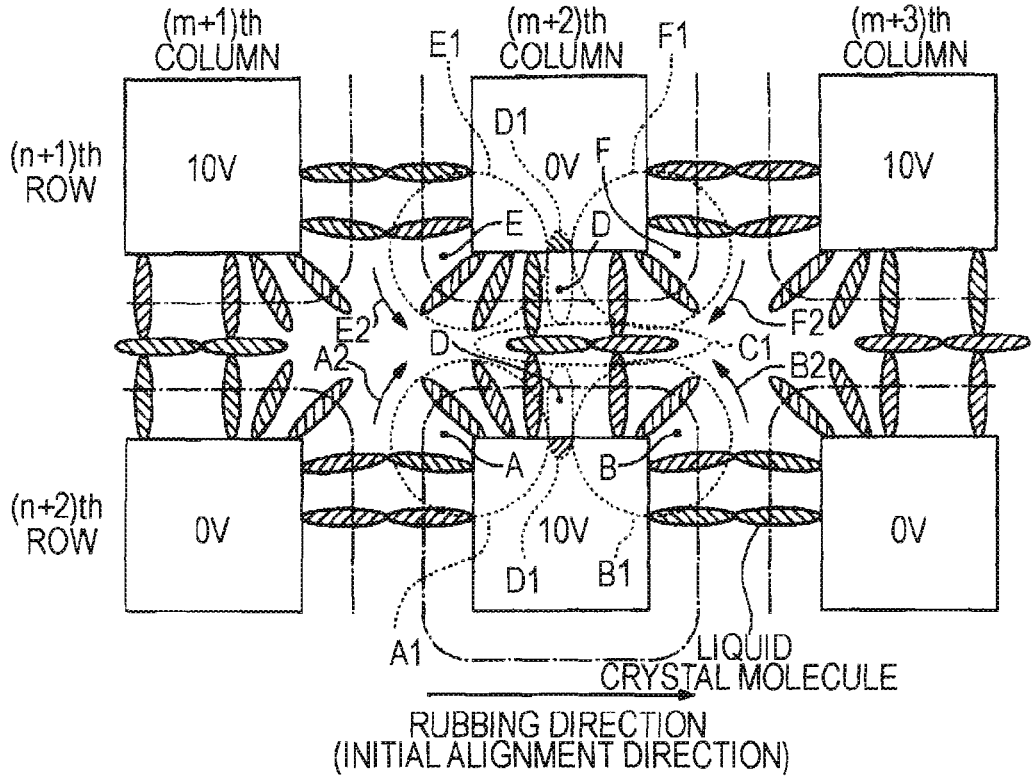
FIG. 20 is a view for explaining the behavior of liquid crystal molecules according to the dot inversion driving of related art.

The drawing corresponding to an example of the dot inversion driving of related art in contrast to the FIG. 7 of this embodiment is FIG. 20. In the example shown in FIG. 20, the voltages of 0 V and 10 V are alternately applied to the pixel electrodes adjacent to each other for every row and every column. In FIG. 20 and the following similar drawings, dashed line indicates equipotent lines.

Although liquid crystal molecules are aligned along the row direction along the rubbing direction when no voltage is applied, the liquid crystal molecules have a positive dielectric anisotropy. Thus, if a voltage is applied, as shown in FIG. 20, the liquid crystal molecules rotate along the direction of an electric field (in other words, in direction orthogonal to the equipotential lines).

Here, when attention is paid to the regions surrounded by circles A1, B1, E1, and F1 which are indicated by broken lines in FIG. 20, in the regions A1 and F1, the liquid crystal molecules in the vicinity of an A point and an F point, which have faced the row direction when no voltage is applied, begin to rotate from the direction in which the angle defined between the row direction and the major axis of the liquid crystal molecules is small toward the direction in which the angle becomes large when voltage is applied. Thus, the liquid crystal molecules rotate in the direction (clockwise) of arrows A2 and F2.

On the other hand, in the regions B1 and E1, the liquid crystal molecules in the vicinity of a B point and an E point, which have faced the row direction when no voltage is applied, rotate in the direction (counterclockwise) of arrows B2 and E2 opposite to the regions A1 and F1 when voltage is applied. Accordingly, as described above, transfer begins using pixel-electrode-related portions D1 (shaded portions) of regions D (disclination regions) at a boundary between the region A1 and the region B1 with rotating directions different from each other and at a boundary between the region E1 and the region F1 as starting points of generation of transfer nuclei.

However, if attention is paid to a boundary between the region A1 and the region E1 and a boundary between the region B1 and the region F1, i.e., the regions C1 surrounded by an ellipse, as for this region, the rotating direction of the liquid crystal molecules which have faced the row direction when no voltage is applied will not be settled instantaneously. Under this influence, the rotation of the liquid crystal molecules in the vicinity of the A point, B point, E point, and F point is retarded. As a result, since retardation also occurs in formation of boundaries in different rotating directions in the region C1, generation of transfer nuclei becomes slow. This becomes a cause that initial transfer cannot be accelerated sufficiently.

Figure 21:
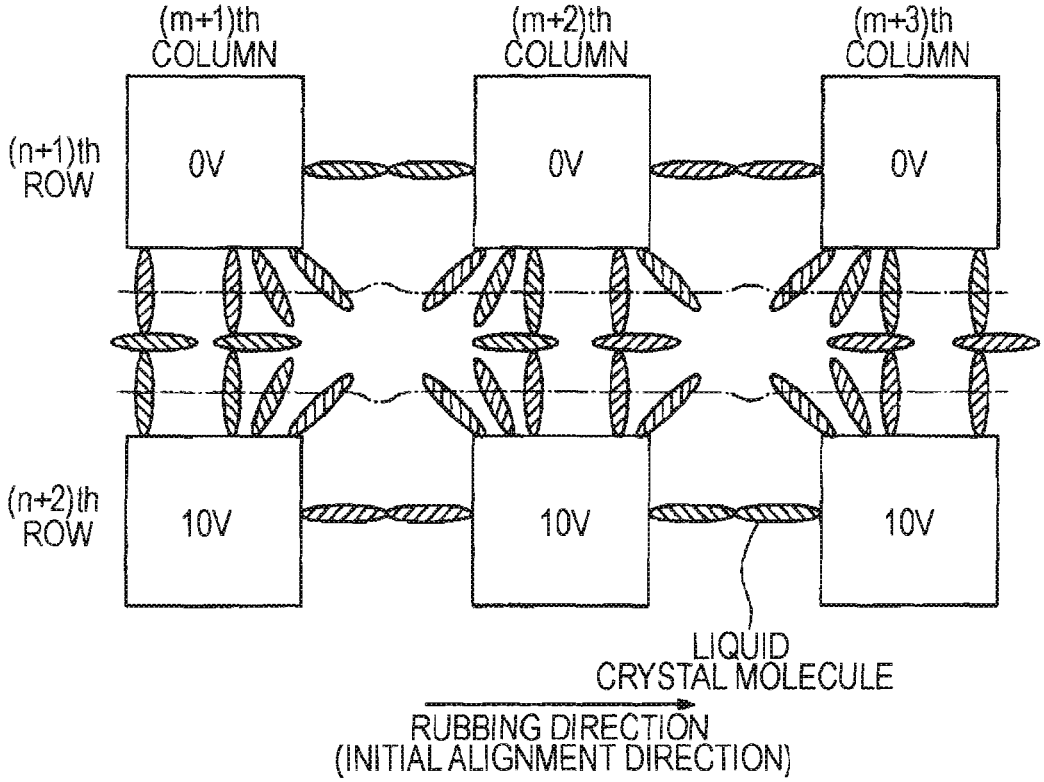
FIG. 21 is a view for explaining the behavior of liquid crystal molecules according to the line inversion driving of related art.

Moreover, the drawing corresponding to an example of the line inversion driving of related art as another comparative example is FIG. 21. In the example shown in FIG. 21, the voltage of 0 V is applied to all the pixel electrodes in each row, and the voltage of 10 V is applied to all the pixel electrodes in a row adjacent to this row. Although the line inversion driving shown in this drawing differs from the dot inversion driving of related art shown by FIG. 20 only in the shape of equipotential lines, the behavior of liquid crystal molecules resembles the example shown in FIG. 20. Thus, even in this line inversion driving, transfer nuclei are hardly generated in the vicinity of the center between individual rows, and initial transfer cannot be accelerated sufficiently.

In contrast to these, according to this embodiment, as shown in FIG. 7, an equal voltage is applied to all the pixel electrodes in the (n+2)th row. Also, if attention is raid to the pixel electrodes in the (n+1)th row and the pixel electrodes in the (n+3)th row, which are adjacent to the (n+2)th row in the column direction (omitted in FIG. 7), the pixel electrodes (pixel electrodes to which 0 V is applied) which have potential lines which go around themselves, appear alternately. Therefore, as shown in FIG. 7, when attention is paid to two regions surround by circles A3 and B3 indicated by broken lines, the liquid crystal molecules in the vicinity of the A point, which have faced the row direction when no voltage is applied, rotate in the direction (clockwise) of an arrow A4 in the region A3. On the other hand, in the region B3, the liquid crystal molecules in the vicinity of a B point, which have faced the row direction when no voltage is applied, rotate in the direction (counterclockwise) of an arrow B4 opposite to the region A3 when voltage is applied.

Accordingly, as described above, transfer begins using a pixel-electrode-related portion D1 (shaded portion) of a region D (disclination regions) at a boundary between the region A3 and the region B3 with rotating directions different from each other as a starting point of generation of a transfer nucleus, and thereby a bend alignment region is enlarged.

That is, in FIG. 7, the voltage between the pixel electrodes in the (n+1)th row and the (n+2)th row, and the voltage between the pixel electrode in the (m+2)th column located in the center of the (n+1)th row and both the pixel electrodes in the (m+1)th column and (m+3)th column adjacent thereto, are a voltage which generates regions in which the rotating directions of liquid crystal molecules differ from each other, in other words, a voltage which causes disclination at a boundary between the regions.

Although the configuration described hitherto is the same as that of the dot inversion driving of related art shown in FIG. 20, this embodiment is different from that in FIG. 20 in that, when attention is paid to an equipotential line between adjacent rows, the equipotential line do not have a portion extending linearly in the row direction, but has a portion curved so as to be convex upwardly. Therefore, in this embodiment, a location (region C1 in FIG. 20) where liquid crystal molecules have faced the row direction and their rotating directions are not settled does rot exist, and the liquid crystal molecules in the vicinity of the center between rows also tend to rotate necessarily in any one of clockwise and counterclockwise rotating directions. Thus, it becomes easy to generate transfer nuclei as a whole compared with the case of the dot inversion driving in FIG. 20.

Although the case of the ith frame has been described with reference to FIG. 6, since all the directions of the electric fields in FIG. 6 are only reversed and their intensities are the same, it becomes easy to generate transfer nuclei similarly to the (i+1)th frame.

Accordingly, according to the liquid crystal device of this embodiment, since the time required to perform the initial transfer for the liquid crystal located in the vicinity of the center between rows as well as the liquid crystal sandwiched between the pixel electrodes and the common electrode can be shortened particularly without contriving the shape of pixel electrodes, an OCB-mode liquid crystal device with high-speed responsiveness can be realized.

In addition, although only nine pixel electrodes of three rows by three columns are picked out and illustrated in FIG. 6, the pixel electrodes which are not shown are repeated in the pattern shown in FIG. 6.

Moreover, although actual liquid crystal molecules are extremely small compared with the pixel electrodes, the liquid crystal molecules are enlarged in FIGS. 7, 20, and 21 for description thereof (this is also true of FIG. 10, FIG. 13, and FIG. 15 as will be described below).

Furthermore, although the first embodiment has been described in conduction with the case in which the rubbing direction is set to the extending direction of the scanning lines 3*a* as the a row direction, and the voltages of 10 V and 0 V are switched and applied for every frame to the pixel electrodes 9 in the (n+2)th row in the transfer mode, the rubbing direction may be set to the extending direction of the data lines 6*a*, a voltage pattern obtained by rotating the voltage pattern shown in FIG. 6 by 90 degrees clockwise (or counterclockwise) may be applied to pixel electrodes. That is, the row direction and the column direction in the invention are concepts relative to each other, and are the relationship between one side and the other in a matrix arrangement.

Second Embodiment

First, a liquid crystal device according to a second embodiment of the invention will be described.

The configuration of the liquid crystal device according to this second embodiment is similar to that of the first embodiment shown in FIGS. 1, 2, and 3, and different therefrom only in the pattern of voltages to be applied to the pixel electrodes 9 in the transfer mode. Therefore, in the second embodiment, only a voltage pattern to be applied to the pixel electrodes 9 in the transfer mode will be described.

Figure 8:
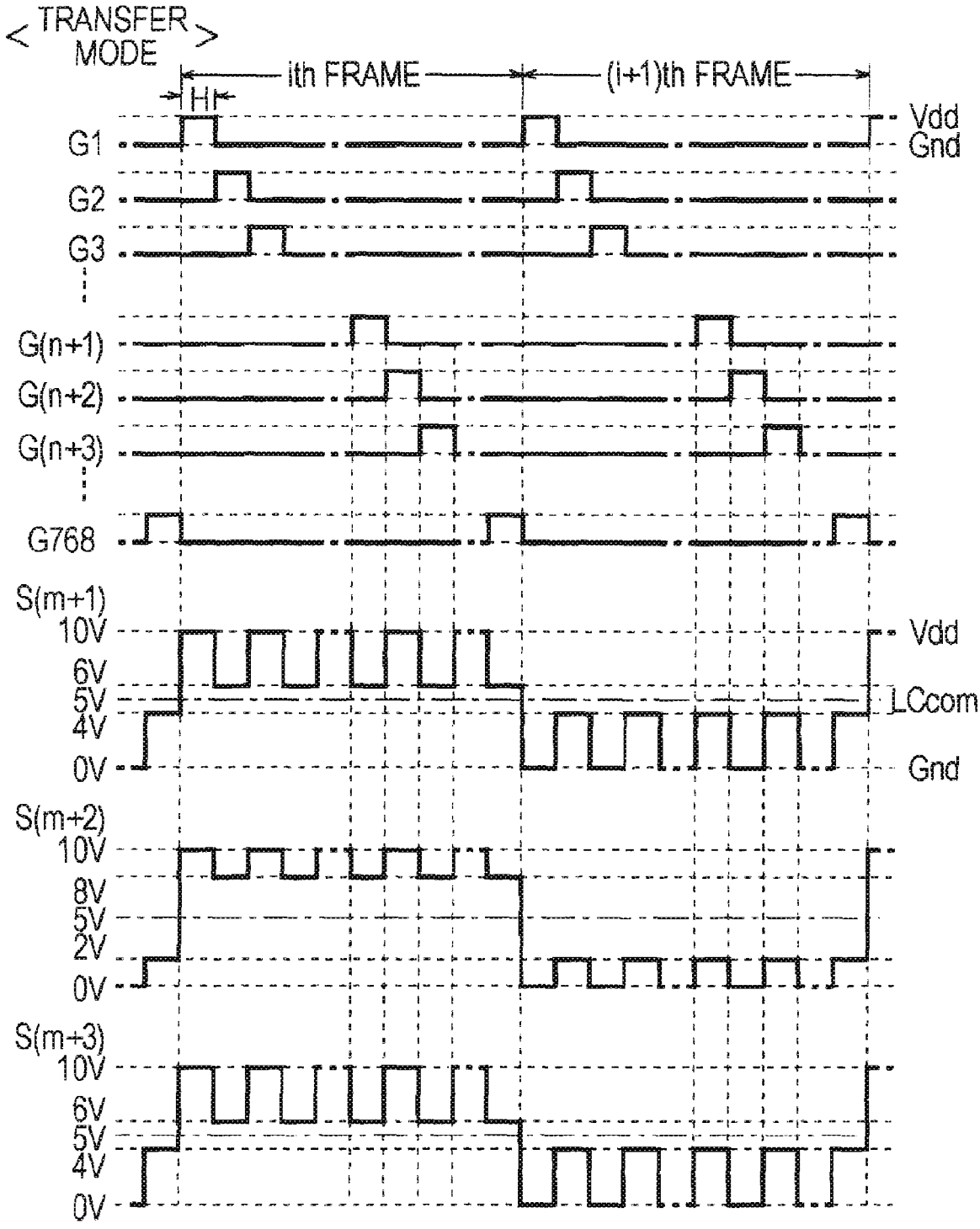
FIG. 8 is a view showing signal waveforms in a transfer mode of a liquid crystal device according to a second embodiment.
Figure 9:
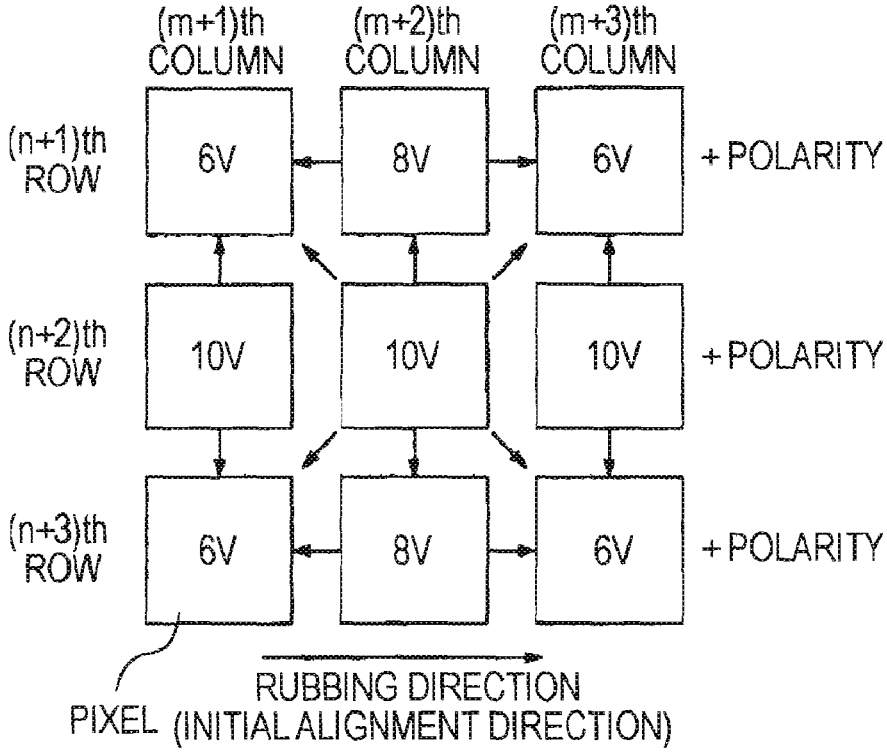
FIG. 9 is a view showing an applied voltage pattern to individual pixel electrodes in the transfer mode.
Figure 10:
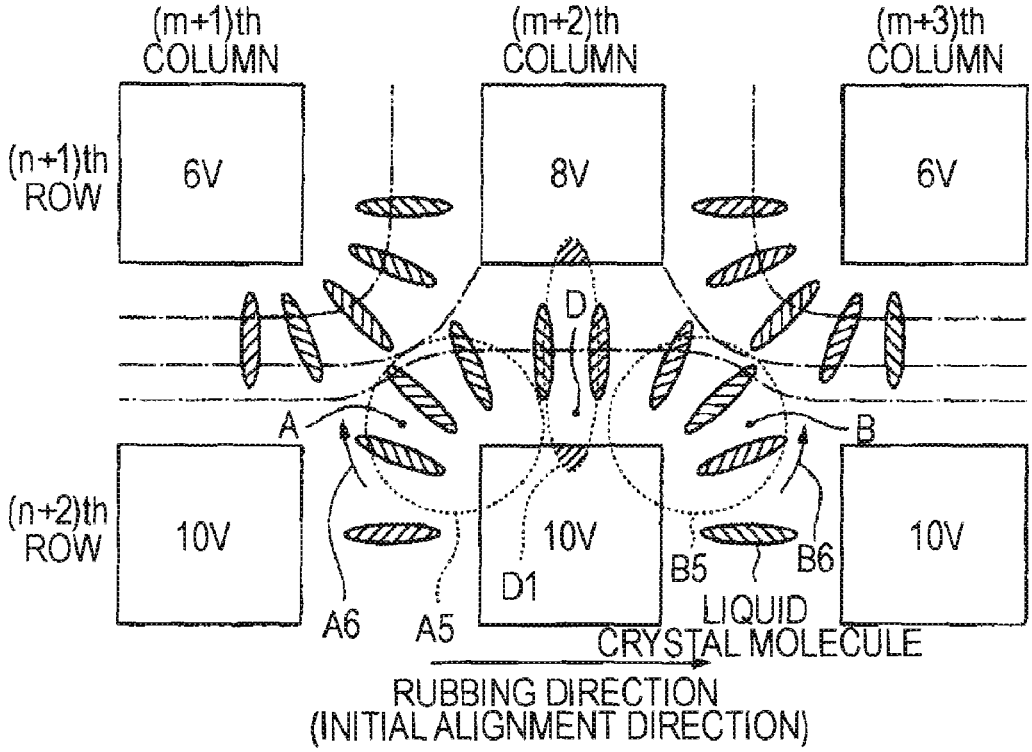
FIG. 10 is a view for explaining the behavior of liquid crystal molecules in the transfer mode.

Therefore, the description of the second embodiment will be made with reference to FIG. 8 showing a signal waveform to be applied in the transfer mode, FIG. 9 showing a voltage pattern to be applied to the pixel electrodes 9, and FIG. 10 showing the behavior of liquid crystal molecules.

As shown in FIGS. 8 and 9, in a certain ith frame, positive polarity voltages are applied to all the pixel electrodes in the (n+1)th row, the (n+2)th row, and the (n+3)th row (the whole display region including these). However, in the next (i+1)th frame, as shown in FIG. 8, polarity is reversed and voltages of negative polarity are applied to all the pixel electrodes. That is, the second embodiment is frame inversion driving.

Specifically, in the ith frame, the voltages of 6 V, 8 V, and 6 V are applied to the pixel electrodes in the (n+1)th row and (n+3)th row, respectively, in order of (m+1)th column→(m+2)th column→(m+3)th column while the voltages of 10 V are applied to the pixel electrodes in the (n+2)th row for all these columns. Since the voltage of the common electrode 25 is 5 V, all the above voltages have positive polarity.

In the second embodiment, although the values of voltages value applied to individual pixel electrodes 9 differ from each other, the relationship between the levels of applied voltages to adjacent individual pixel electrodes is completely the same as that of the first embodiment shown in FIG. 6.

Accordingly, in the second embodiment, when 6 V and 8 V are alternately applied to the pixel electrodes in the (n+1)th row and (n+3)th row for every column, and 10 V is applied to the pixel electrodes in the (n+2)th row, as shown in FIG. 9, the existence or nonexistence of arrows indicating an electric field between the pixel electrodes, and the direction of the arrows are completely the same as that of the first embodiment.

That is, even in the second embodiment, an equal voltage is applied to all pixel electrodes in the (n+2)th row. Also, to a plurality of pixels in the (n+1)th row and (n+3)th row adjacent to the (n+2)th row in the column direction are applied voltages, such both applied voltages to both the two pixel electrodes adjacent to an arbitrary one pixel electrode in one row, which are higher than or lower than a voltage applied to the central one pixel electrode. In addition, all of these applied voltages are more than a threshold voltage required for the initial transfer to the bend alignment from the spray alignment.

Accordingly, as shown in FIG. 10, since the shape of equipotential lines is almost the same as that of the first embodiment (it can safely be said that their shapes are not completely the same because voltage values differ actually, but they are almost the same), the behavior of liquid crystal molecules is the same as that of the first embodiment.

Therefore, in the second embodiment, potential differences are caused among all the other pixel electrodes excluding between adjacent pixel electrodes in a row (the (n+2)th row in FIG. 10) to which 10 V is applied to pixel electrodes in the ith frame, that is, 0 V is applied to pixel electrodes in the (i+1)th frame. Thus, horizontal electric fields tend to be generated among these pixel electrodes, and liquid crystal molecules tend to rotate in a plane by this horizontal electric field. At this time, since the liquid crystal molecules in the vicinity of the center between rows also rotate in either rotating direction of a clockwise direction (A6 direction) and a counterclockwise direction (B6 direction) unlike the dot inversion driving of related art, it becomes easy to generate transfer nuclei and initial transfer can be accelerated sufficiently. Therefore, even when the frame inversion driving as in the second embodiment is performed, the time required for the initial transfer can be shortened particularly without contriving the shape of pixel electrodes, and an OCB-mode liquid crystal device with high-speed responsiveness can be realized.

In addition, even in this embodiment, in FIG. 10, the voltage between the pixel electrodes in the (n+1)th row and the (n+2)th row, and the voltage between the pixel electrode in the (m+2)th column located in the center of the (n+1)th row and both the pixel electrodes in the (m+1)th column and (m+3)th column adjacent thereto, are a voltage which generates regions in which the rotating directions of liquid crystal molecules differ from each other, and which causes disclination at a boundary between the regions. Moreover, in the (i+1)th frame, since only the direction of electric fields is reversed, the description thereof is omitted.

Third Embodiment

Subsequently, a liquid crystal device according to a third embodiment of the invention will be described.

The configuration of the liquid crystal device according to this third embodiment is also similar to that of the first embodiment, and different from the first and second embodiments only in the pattern of voltages to be applied to the pixel electrodes 9 in the transfer mode. Therefore, in the third embodiment, only signal waveforms to be applied and a voltage pattern to be applied to the pixel electrodes 9 in the transfer mode will be described with reference to FIGS. 11 to 17.

In the first and second embodiments, like the (n+2)th row as an illustrative example, a row in which an equal voltage (for example, 10 V) is applied to all the pixel electrodes lined up in the row direction exists. To the pixel electrodes in the upper and lower rows adjacent to this row, different voltages (in the first embodiment, 0 V and 10 V in the (m+1)th column, and 3 V and 10 V in the (m+1)th column) between the pixel electrodes adjacent to each other in the same column direction are applied, respectively. However, the invention is not limited thereto, and even if any row in which an equal voltage is applied to pixel electrodes does not exist, the invention is realized. This means that different voltages are applied to two pixel electrodes adjacent to each other in the row direction in one row, and different voltages are applied to two pixel electrodes adjacent to each other in the column direction in one column. Accordingly, this example will be described below, paying attention to adjacent four pixel electrodes of two rows by two columns.

Figure 11:
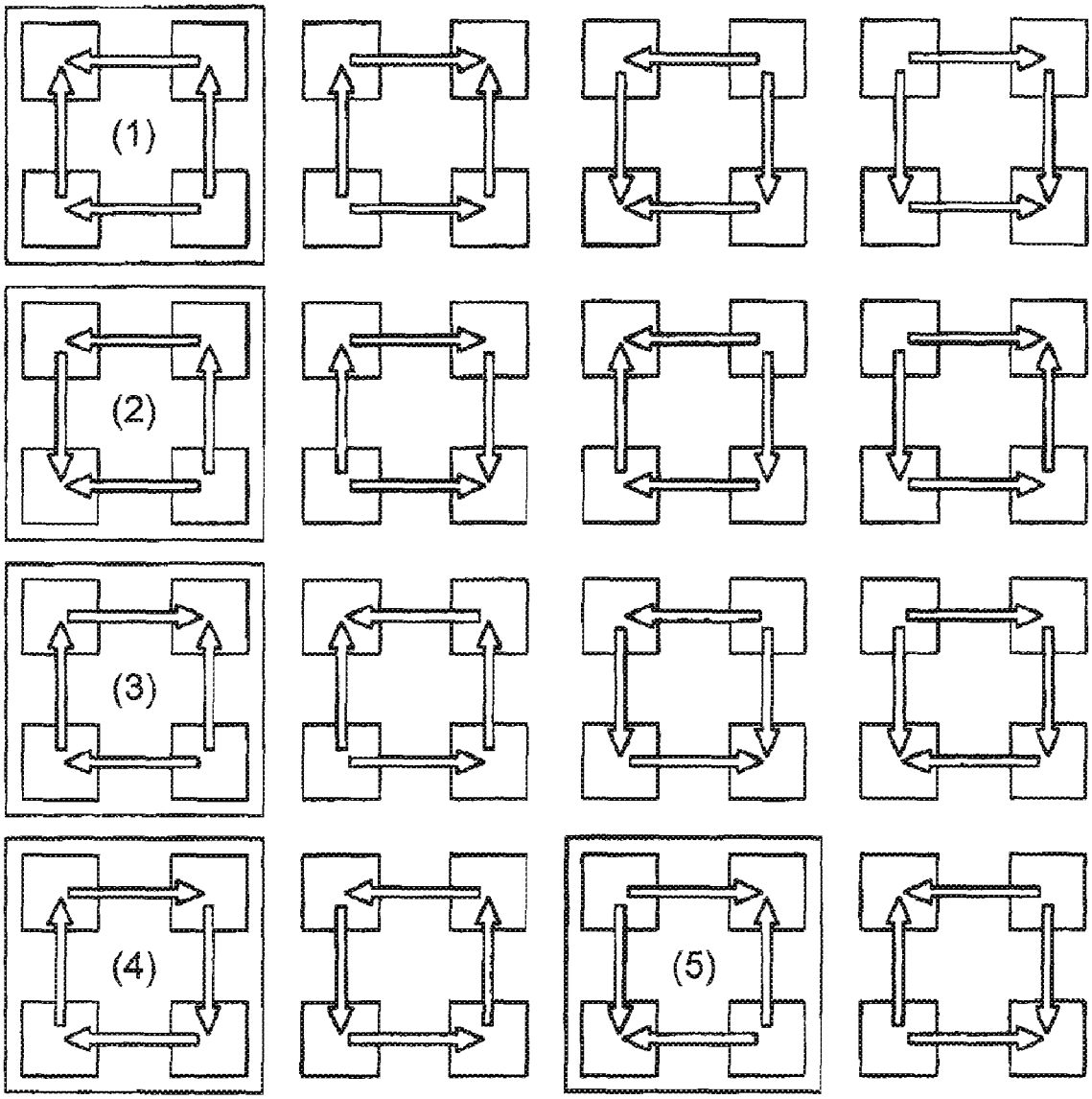
FIG. 11 is a view showing a combination of applied voltage patterns in a third embodiment.

In adjacent four pixel electrodes of two rows by two columns, when different voltages are applied to two pixel electrodes adjacent to each other in the row direction or the column direction, it is conceivable that the level-related patterns of voltages are $2^4$=16 kinds of patterns, as shown in FIG. 11. Meanwhile, since the patterns which overlap each other from the symmetric property are included in these sixteen kinds of patterns, substantially different patterns are five kinds of patterns indicated by (1) to (5) in FIG. 11. Therefore, in the following, these five kinds of patterns will be discussed. In addition, the way indicated by arrows is the same as that in FIG. 5, etc., and the base end of each arrow indicates the high voltage side, and the tip end of the arrow indicates the low voltage side.

Moreover, the case of the line inversion is exemplified in the third embodiment. For example, it is assumed that the (n+1)th row has negative polarity and the (n+2)th row has positive polarity.

Figure 12:
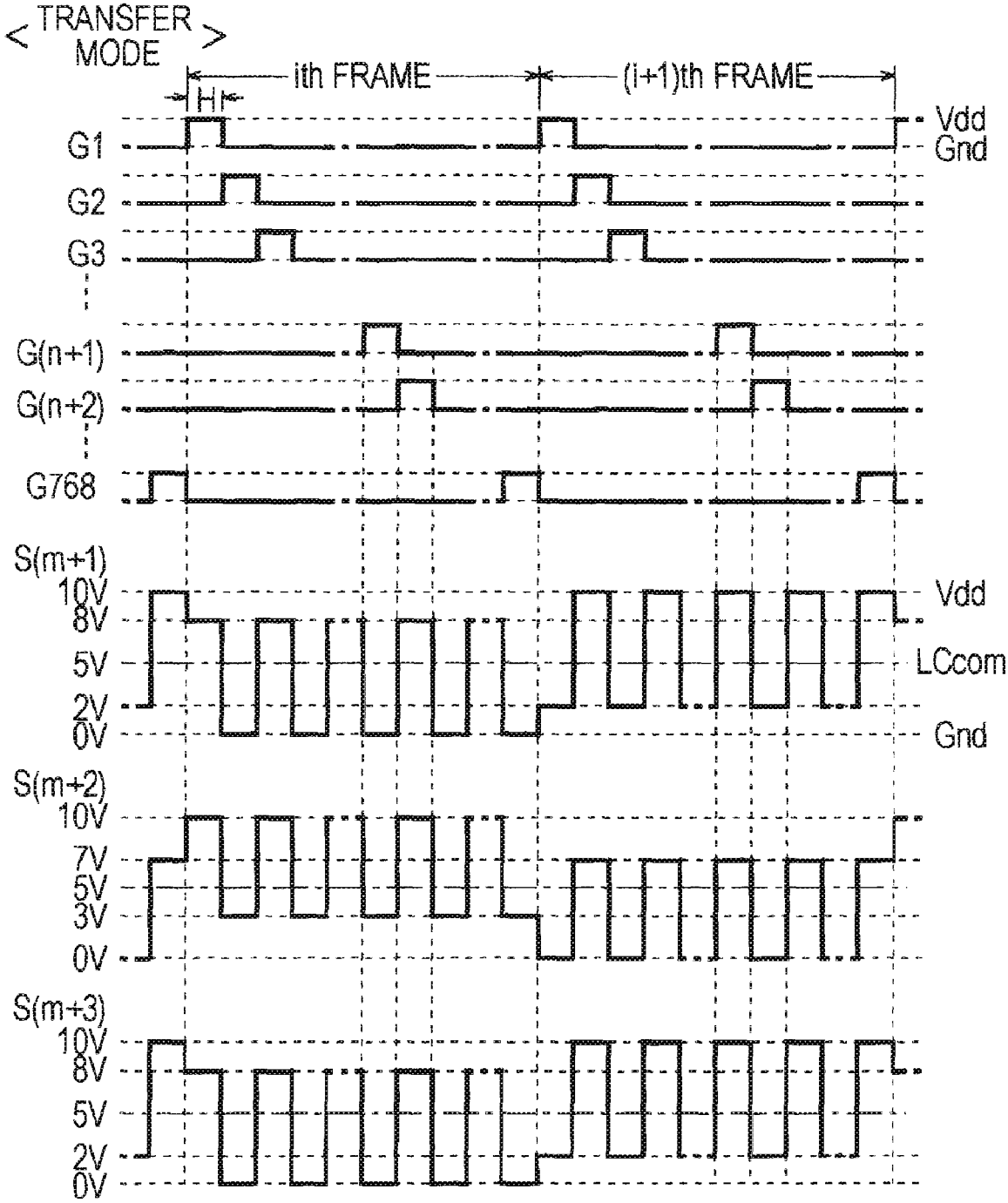
FIG. 12 is a block diagram showing signal waveforms in the liquid crystal device.
Figure 13:
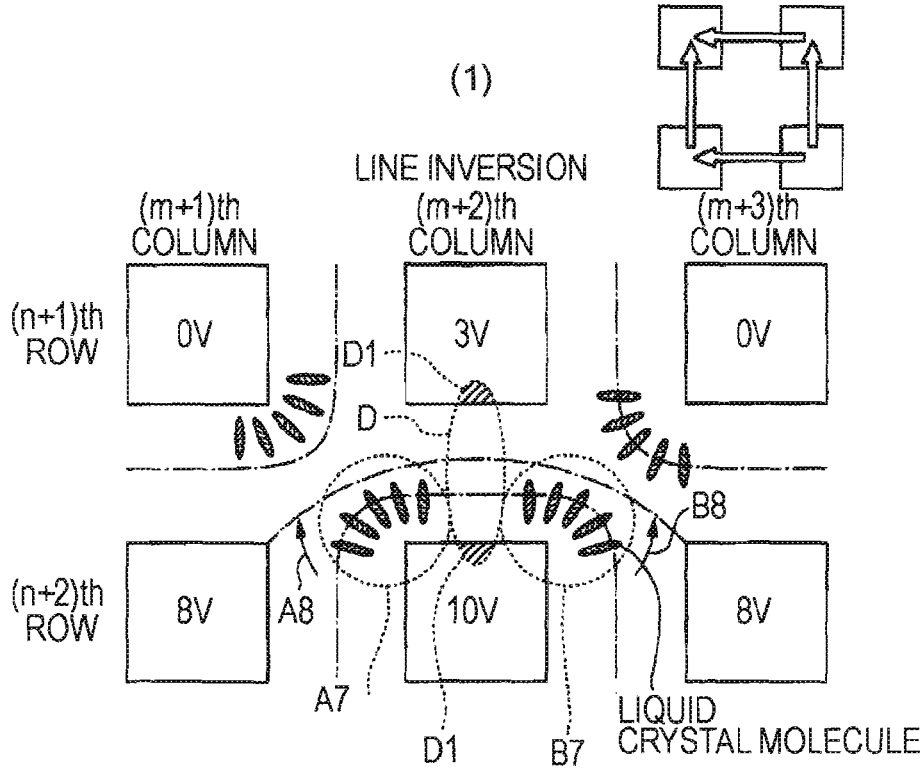
FIG. 13 is a view showing an applied voltage pattern to individual pixel electrodes in the transfer mode.

First, with respect to the pattern (1), as shown in FIG. 13, the voltages of the pixel electrodes in the (m+1)th column are made higher than the voltages of the pixel electrodes in the (m+2)th column in the (n+1)th row and the (n+2)th row as seen in the row direction by making scanning signals and data signals into waveforms as shown in the ith frame in FIG. 12. Furthermore, the voltages of the pixel electrodes in the (n+2) th row is made higher than the voltages of the pixel electrodes in the (n+1)th row in the (m+1)th column and the (m+2)th column as seen in the column direction. Specifically, if the line inversion driving is taken as an example, 0 V is applied to a pixel electrode in the (m+1)th column in the (n+1)th row, 3 V is applied to a pixel electrode in the (m+2)th column in the (n+1)th row, 8 V is applied to a pixel electrode in the (m+1)th column in the (n+2)th row, and 10 V is applied to a pixel electrode in the (m+2)th column in the (n+2)th row.

If the aspect of equipotential lines when voltages are applied in this way is shown in FIG. 13, as compared with FIG. 7 of the first embodiment, the third embodiment and first embodiments are different from the viewpoint of the existence or nonexistence of any equipotential line between adjacent pixel electrodes in the (n+2)th row, but are well similar from the viewpoint of influence on the alignment direction of liquid crystal molecules. That is, liquid crystal molecules rotate in the direction (clockwise) of an arrow A8 in a region A7, while liquid crystal molecules rotate in the direction (counterclockwise) of an arrow B8 in a region B7. Accordingly, transfer begins using pixel-electrode-related portions D1 (shaded portions) of a region D (disclination region) at a boundary between the region A7 and the region B7 as starting points of generation of transfer nuclei. An equipotential line between adjacent rows is curved and the liquid crystal molecules in the vicinity of the center between rows also necessarily rotate in any rotating direction of a clockwise direction and a counterclockwise direction. As a result, it becomes easy to generate transfer nuclei and initial transfer can be accelerated sufficiently.

In addition, in FIG. 13, the voltage between the pixel electrodes in the (n+1)th row and the (n+2)th row, and the voltage between the pixel electrode in the (m+2)th column located in the center of the (n+1)th row and both the pixel electrodes in the (m+1)th column and (m+3)th column adjacent thereto, are a voltage which generates regions in which the rotating directions of liquid crystal molecules differ from each other, and which causes disclination at a boundary between the regions. Moreover, in the (i+1)th frame, since only the direction of electric fields is reversed, the description thereof is omitted.

Figure 14:
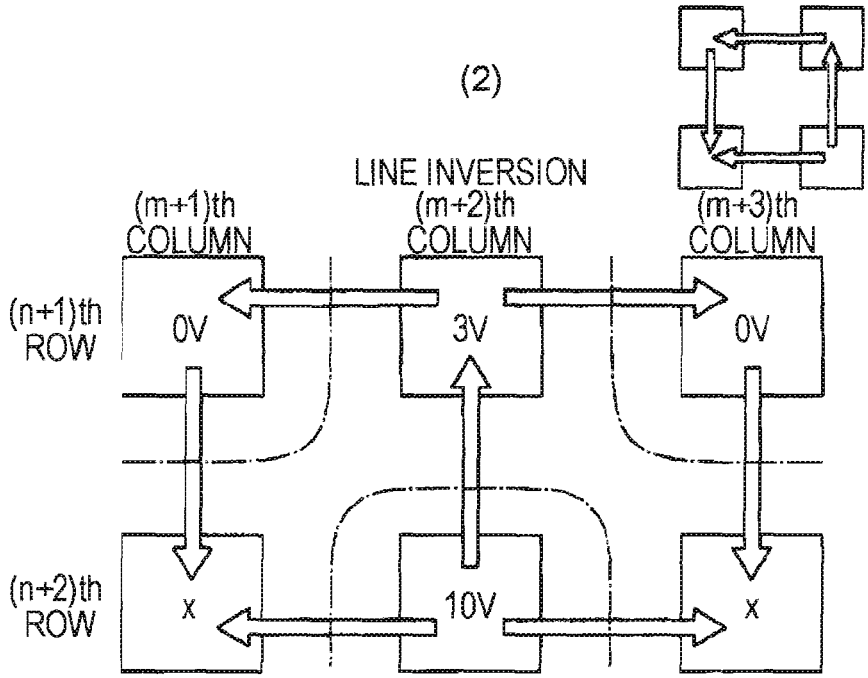
FIG. 14 is a view showing an applied voltage pattern to individual pixel electrodes in the transfer mode.

Next, with respect to the pattern (2), as shown in FIG. 14, a voltage (voltage which is lower than 10 V and lower than 0 V) that satisfies the relationship between the levels of voltages as indicated by the arrows cannot be obtained in a pixel electrode in the (m+1)th column in the (n+2)th row (lower left), and a pixel electrode in the (m+3)th column in the (n+2)th row (lower right).

Figure 15:
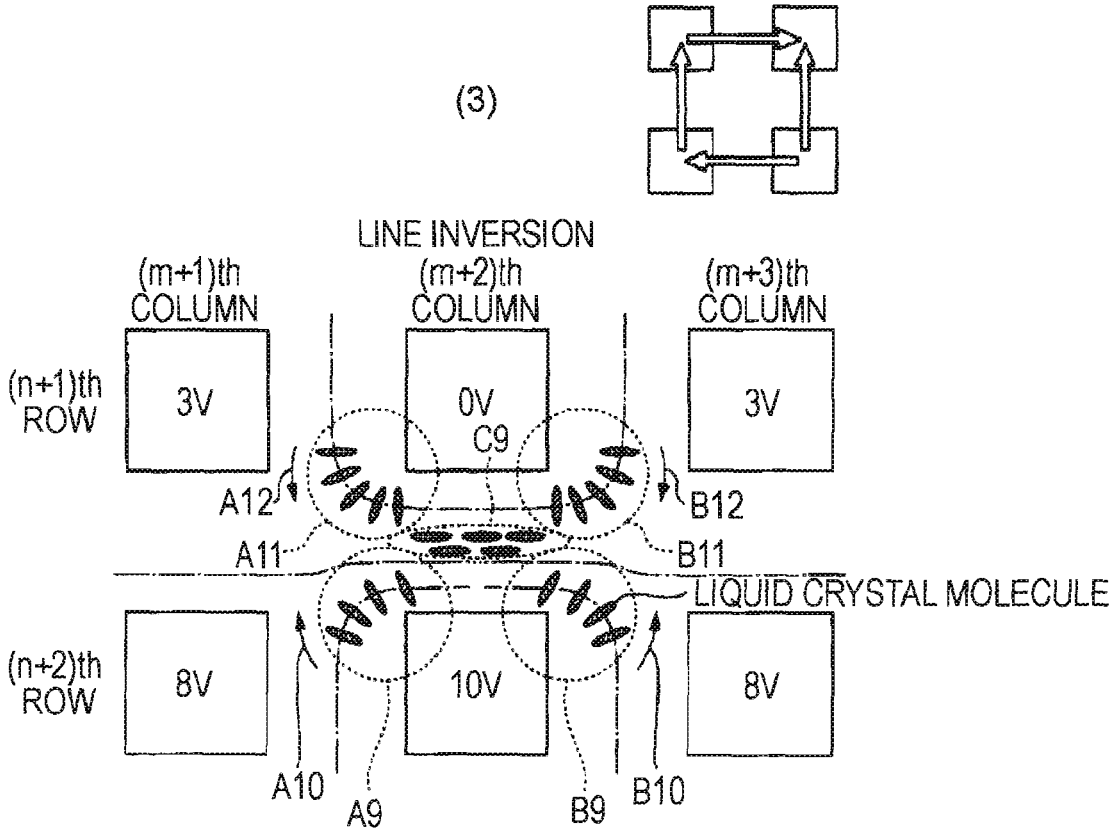
FIG. 15 is a view showing an applied voltage pattern to individual pixel electrodes in the transfer mode.

Subsequently, with respect to the pattern (2), for example, as shown in FIG. 15, as seen in the row direction, the applied voltage of a pixel electrode in the (m+2)th column is made lower than the voltage applied to a pixel electrode in the (m+1)th column in the (n+1)th row and the applied voltage of a pixel electrode in the (m+2)th column is made higher than the voltage applied to a pixel electrode in the (m+1)th column in the (n+2)th row. Furthermore, the applied voltages to the pixel electrodes in the (n+2)th row is made higher than the voltages applied to the pixel electrodes in the (n+1)th row in both the (m+1)th column and the (m+2)th column as seen in the column direction. Specifically, 3 V is applied to a pixel electrode in the (m+1)th column in the (n+1)th row, 0 V is applied to a pixel electrode in the (m+2)th column in the (n+1)th row, 8 V is applied to a pixel electrode in the (m+1)th column in the (n+2)th row, and 10 V is applied to a pixel electrode in the (m+2)th column in the (n+2)th row.

The aspect of equipotential lines when voltages are applied in this way, as shown in the same drawing, is such that an equipotential line between adjacent rows extends substantially in the shape of a straight line in the row direction, and goes around the pixel electrode to which 0 V is applied and the pixel electrode to which 10 V is applied, respectively. That is, the aspect of equipotential lines is slightly similar to that of the dot inversion driving of related art in FIG. 20. Specifically, liquid crystal molecules rotate in the direction (clockwise) of arrows A10 and B12 in regions A9 and B11, while liquid crystal molecules rotate in the direction (counterclockwise) of arrows A12 and B10 in regions A11 and B9.

Meanwhile, if attention is paid to a region C9 in the vicinity of the center between rows, in this region, the rotating direction of liquid crystal molecules which have faced the row direction from the beginning when no voltage is applied will not become settled instantaneously. Therefore, the rotation of the liquid crystal molecules in the regions A9, B9, A11, and B11 is retarded. As a result, since retardation also occurs in formation of boundaries in different rotating directions between the regions A9 and B9 and between the regions A11 and B11, generation of transfer nuclei becomes slow, and thus the initial transfer cannot be accelerated sufficiently.

Figure 16:
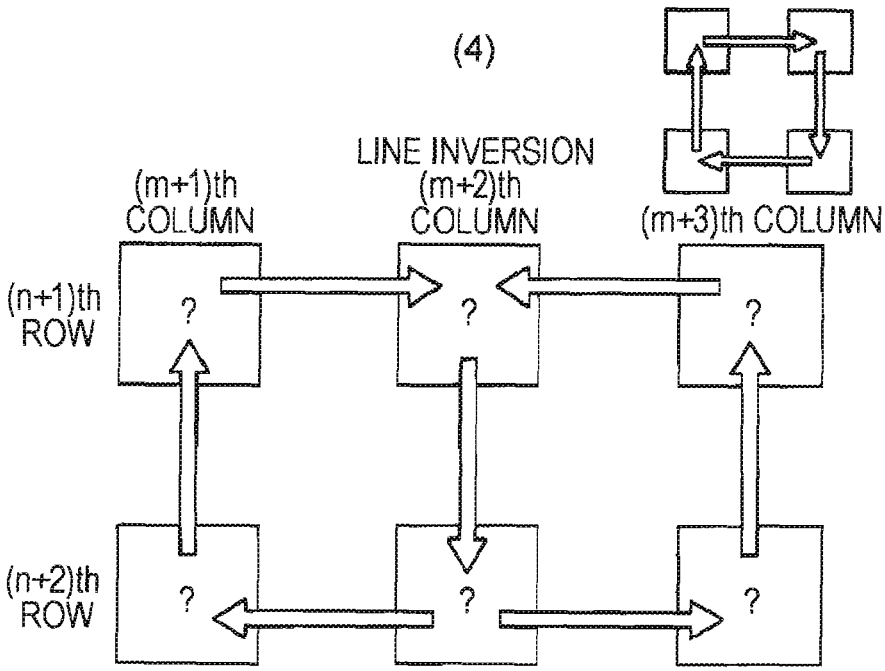
FIG. 16 is a view showing an applied voltage pattern to individual pixel electrodes in the transfer mode.
Figure 17:
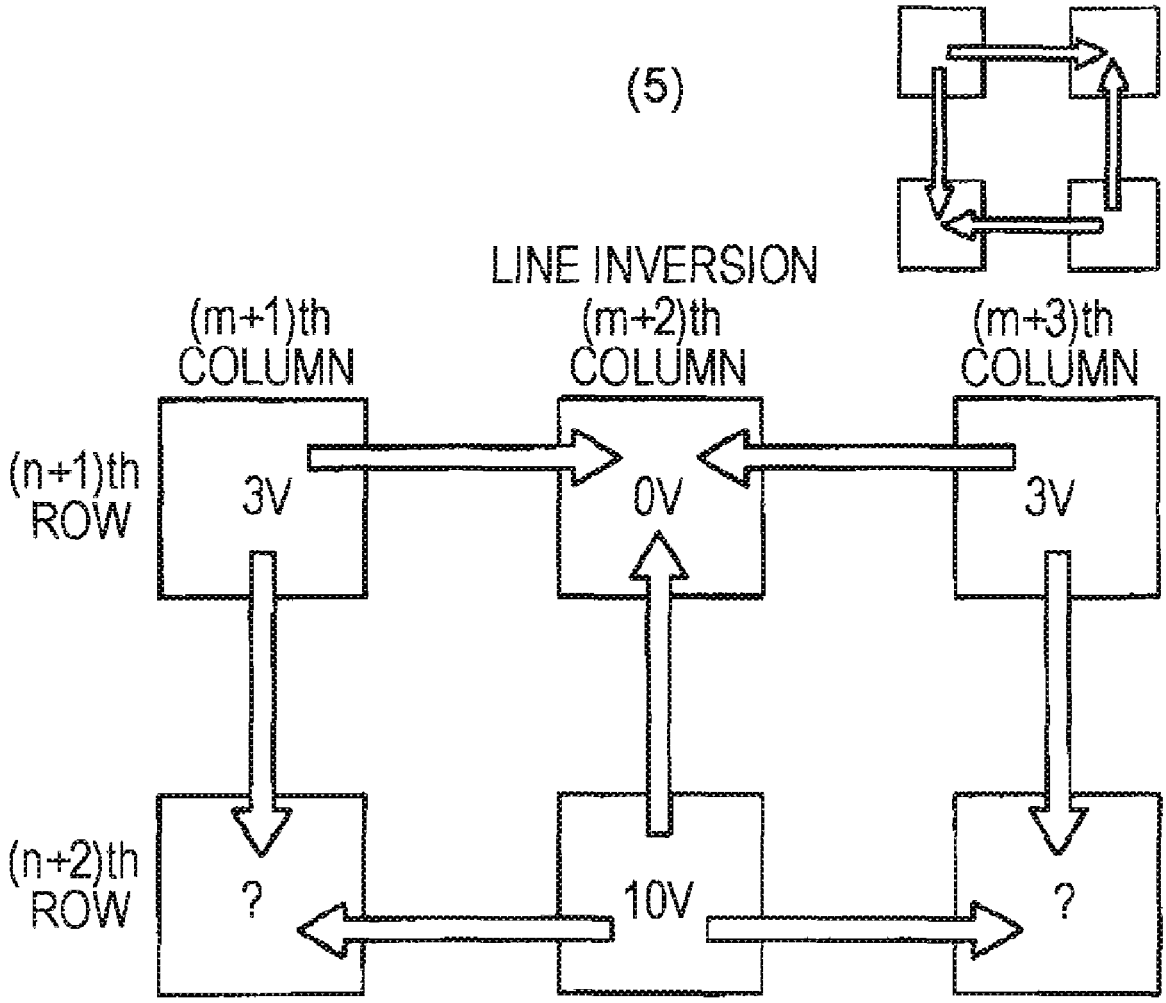
FIG. 17 is a view showing an applied voltage pattern to individual pixel electrodes in the transfer mode.

In addition, with respect to the pattern (4), as shown in FIG. 16, a voltage that satisfies the relationship between the levels of voltages as indicated by the arrows can be obtained in all the pixel electrodes. With respect to the pattern (5), as shown in FIG. 17, a voltage (voltage which is lower than 10 V and lower than 3 V) that satisfies the relationship between the levels of voltages as indicated by the arrows cannot also be obtained in a pixel electrode in the (m+1)th column in the (n+2)th row (lower left), and a pixel electrode in the (m+3)th column in the (n+2)th row (lower right).

If the above facts are summarized, only the pattern (1) among five kinds of patterns can accelerate the initial transfer. The pattern (1) has the following features. That is, from the viewpoint of the relationship of the levels of voltages, voltages are applied to four pixel electrodes adjacent to each other in the row direction and the column direction such that, when the applied voltages of the pixel electrodes located in the same column with two pixel electrodes in the (n+1)th row and two pixel electrodes in the (n+2)th row are compared, both the voltages of the pixel electrodes in the (n+2)th row are higher or lower than the voltages of the pixel electrodes in the (n+1) th row, and when the voltages of both the pixel electrodes located in the same row with two pixel electrodes in the (m+1)th column and two pixel electrodes in the (m+2)th column are compared, both the voltages of the pixel electrodes in the (m+2)th column are higher or lower than the voltages of the pixel electrodes in the (m+1)th column.

Moreover, the above pattern has the following features from the viewpoint of the characteristics of equipotential lines. That is, voltages are applied to a plurality of pixel electrodes in the same row such that these electrodes have equipotential lines going around themselves, but the equipotential lines are generated alternately, and voltages are applied to a plurality of pixel electrodes in the same row such that these electrodes have equipotential lines, but the equipotential lines are generated alternately. To be brief, the pattern (1) has a feature of applying voltages such that pixel electrodes having equipotential lines going around themselves may be alternately arranged for every row and for every column.

By adopting such a voltage application pattern, even when patterns other than the first and second embodiments are used, that is, even when different voltages are applied to two pixel electrodes adjacent to each other in the row direction, and different voltages are applied to two pixel electrodes adjacent to each other in the column direction, the time required for the initial transfer can be shortened particularly without contriving the shape of pixel electrodes, and an OCB-mode liquid crystal device with high-speed responsiveness can be realized.

Fourth Embodiment

Next, a liquid crystal device according to a fourth embodiment of the invention will be described.

The configuration of the liquid crystal device according to this fourth embodiment is also similar to that of the first embodiment, and different from other embodiments only in the pattern of voltages to be applied to the pixel electrodes 9 in the transfer mode. Therefore, in the fourth embodiment, signal waveforms to be applied in the transfer mode which are shown in FIG. 18, and a voltage pattern to be applied to the pixel electrodes 9, which are shown in FIG. 19, will be described.

Figure 18:
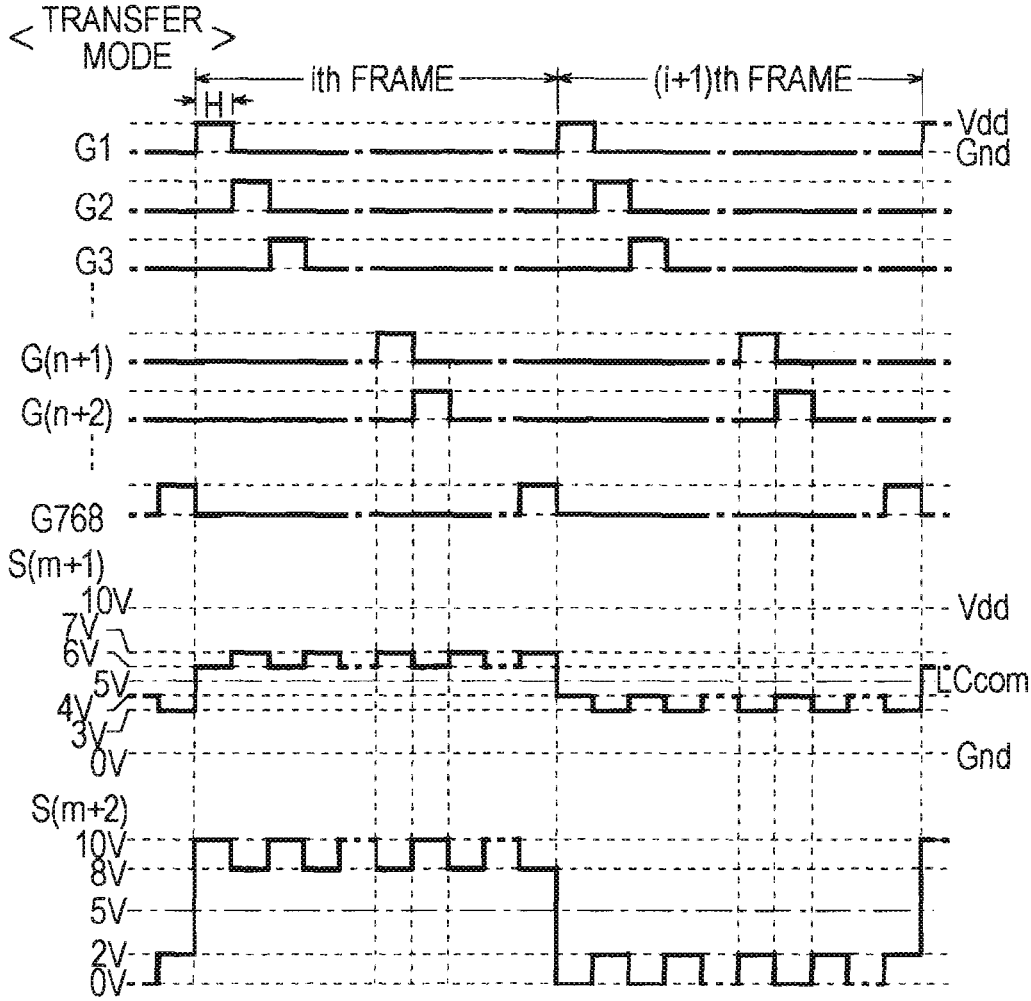
FIG. 18 is a view showing signal waveforms in a liquid crystal device according to a fourth embodiment.
Figure 19:
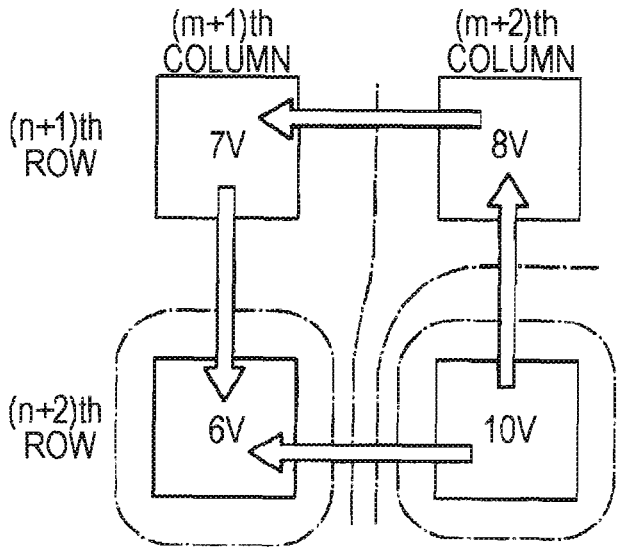
FIG. 19 is a view showing an applied voltage pattern to individual pixel electrodes in the transfer mode.

In the fourth embodiment, as shown in FIGS. 18 and 19, in the ith frame, positive polarity voltages are applied to all the pixel electrodes in the (n+1)th row and the (n+2)th row. However, as shown in FIG. 18, in the next (i+1)th frame, polarity is reversed and voltages of negative polarity are applied to all the pixel electrodes. That is, the fourth embodiment is frame inversion driving. Specifically, in the ith frame, the voltages of 7 V and 8 V are applied in order of (m+1)th column→(m+2)th column to the pixel electrodes, respectively, in the (n+1) th row. On the other hand, the voltages of 6 V and 10 V are applied in order of (m+1)th column→(m+2)th column to the pixel electrodes, respectively, in the (n+2)th row. Since the voltage of the common electrode 25 is 5 V, all the above voltages have positive polarity.

That is, this voltage application pattern is generalized as follows. That is, voltages are applied such that, when voltages of pixel electrodes located in the same column with two pixel electrodes in an arbitrary (n+1)th row and two pixel electrodes in the next (n+2)th row are compared, the voltage of a pixel electrode in the second row is higher than the voltage of a pixel electrode in the first row located in one column ((m+2)th column), and the voltage of a pixel electrode in the second row is lower than the voltage of a pixel electrode in the first row located in the other column ((m+1)th column), and when voltages of pixel electrodes located in the same row with two pixel electrodes in the first column and two pixel electrodes in the second column are compared, both the voltages of pixel electrodes in the second column are higher than or lower than the voltages of pixel electrodes in the first column.

In addition, all of these applied voltages are more than a threshold voltage required for the initial transfer of the liquid crystal 50 sandwiched by the liquid crystal capacitors 55, to the bend alignment from the spray alignment. Moreover, in the (i+1)th frame, since only the direction of electric fields is reversed, the description thereof is omitted.

Accordingly, as shown in FIG. 19, since potential differences are caused among all the pixel electrodes in the (n+2)th row as shown in FIG. 19, equipotential lines tends to be generated among all these pixel electrodes so as to go around themselves, and liquid crystal molecules tend to rotate in a plane. In addition, among all the pixel electrodes in the (n+1) th row, any equipotential line going around the electrodes will not generated, but a row in which equipotential lines are generated between pixel electrodes so as to go around there selves and a row in which any equipotential line is not generated will be produced alternately. At this time, since the liquid crystal molecules in the vicinity of the center between rows also rotate in any rotating direction of a clockwise direction and a counterclockwise direction unlike the dot inversion driving of related art, it becomes easy to generate transfer nuclei and initial transfer can be accelerated sufficiently. Therefore, even when the frame inversion driving as in the fourth embodiment is performed, the time required for the initial transfer can be shortened particularly without contriving the shape of pixel electrodes, and an OCB-mode liquid crystal device with desired high-speed responsiveness can be realized.

In addition, even in the fourth embodiment, in FIG. 19, the voltage between the pixel electrodes in the (n+1)th row and the (n+2)th row, and the voltage between the pixel electrode in the (m+1)th column and the (m+2)th column, are a voltage which generates regions in which the rotating directions of liquid crystal molecules differ from each other, and which causes disclination at a boundary between those pixel electrode regions. The voltage pattern of this embodiment is the same as the pattern (2) among five kinds of patterns discussed in the third embodiment, from the viewpoint of only the size relation of voltages between pixel electrodes. That is, since the third embodiment has a limitation called the line inversion driving, the pattern (2) can not be realized, but if the frame inversion driving is adopted, the pattern (2) can also be realized.

Moreover, although the above individual embodiments have been described in conjunction with the case in which the voltage LCcom applied to the common electrode 25 is made coincide with the reference potential of polarity reversals, when the TFT 30 is an n-channel-type, a phenomenon (called pushdown, running, field-through, etc.) occurs that the potential of the drain (pixel electrode 9) drops at the time from ON to OFF due to the parasitic capacitance between the gate and the drain of the TFT. In order to prevent deterioration of liquid crystal, since alternating current driving is principally adopted in the liquid crystal capacitor 55, mutual writing is carried out on the high potential side (positive polarity) and low potential side (negative polarity) However, if the mutual writing is carried out using the voltage LCcom as the reference potential of polarity reversals, the effective value of a voltage held in the liquid crystal capacitor 55 may become larger in negative-polarity writing than in positive-polarity writing due to the pushdown. Therefore, if the TFT 30 is of an n-channel-type, the voltage LCcom applied to the common electrode 25 may be set to be a little lower than the potential at the center of the amplitude of a data signal so that the effective values of voltages of liquid crystal capacitors may become equal to each other.

Electronic Apparatus

Hereinafter, an embodiment of an electronic apparatus of the invention will be described with reference to FIG. 22.

Figure 22:
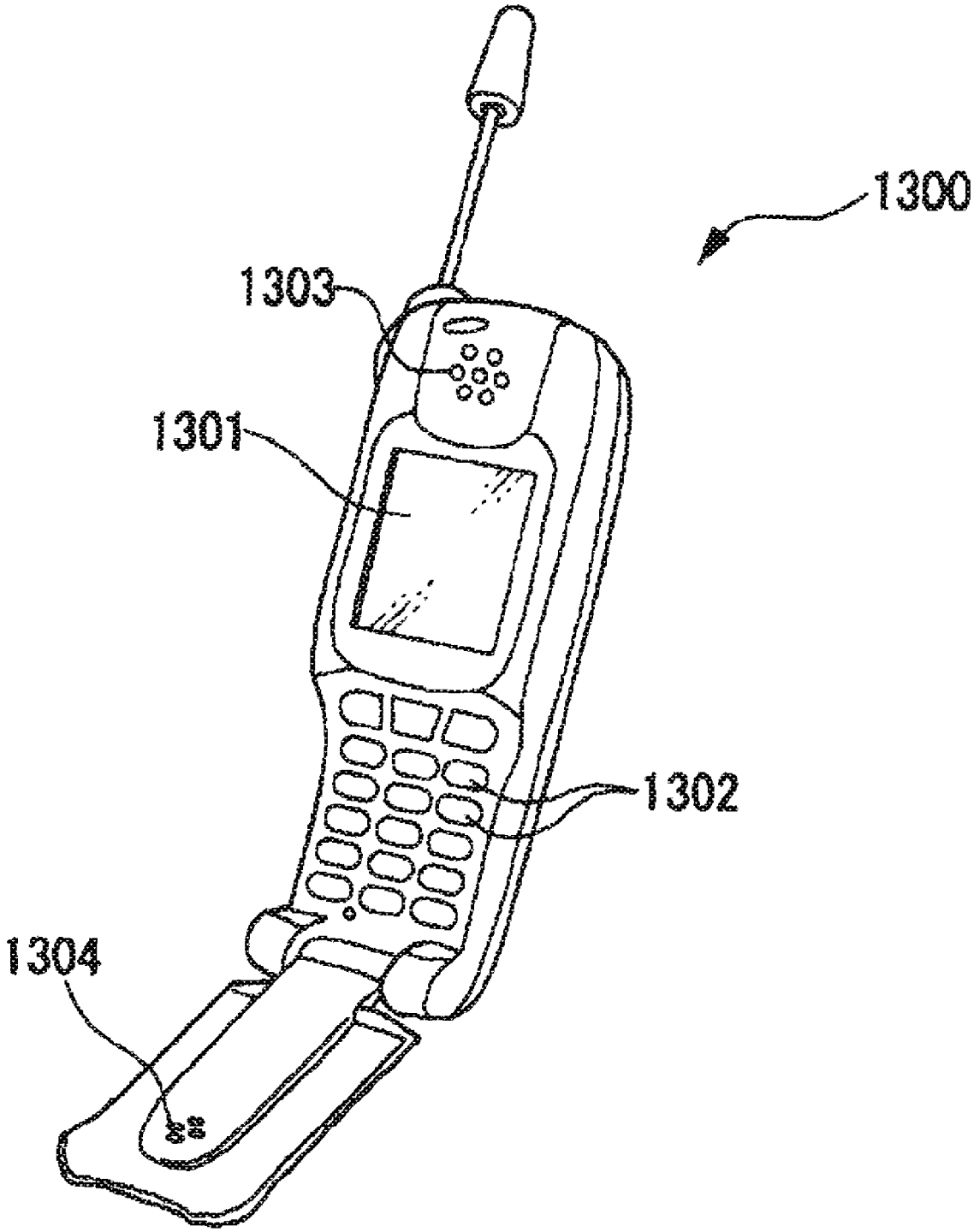
FIG. 22 is a perspective view showing an example of an electronic apparatus.

FIG. 22 is a perspective view of a portable telephone provided with of the liquid crystal device of the above embodiments. As shown in this drawing, the portable telephone 1300 is provided with a display unit 1301 composed of the liquid crystal device of the above embodiment, along with a plurality of manual operation buttons 1302, an earpiece 1303, and a mouthpiece 1304. According to this embodiment, since the portable telephone has the liquid crystal device of the above embodiments high-speed initial transfer can be realized and thereby display with excellent visibility dynamic images according to the OCB mode is achieved.

In addition, it should be understood that the technical scope of the invention is not limited to the above embodiments, but various modifications may be made without departing from the spirit and scope of the invention. For example, the concrete voltage values of the voltage application patterns shown in the above embodiments are just an example, and they can be changed properly. Moreover, the basic configuration of the liquid crystal device is not particularly limited. For example, the invention can also be applied to a liquid crystal device using not TFTs but TFDs (Thin Film Diodes) as pixel switching elements because a plurality of pixel electrodes are arrayed in a matrix on one substrate of a pair of substrates.

The above description is made up of a description about the voltage application pattern applied to the pixel electrodes corresponding to the intersections of the (n+1)th row, the (n+2)th row, and the (n+3)th row, and the (m+1)th column, the (m+2)th column and the (m+3)th column, which represents a portion of the display region 40, and a description about the others as repetition of this voltage application pattern. However, even if the above voltage application pattern is applied to some pixel electrodes of the display region 40, the acceleration of the initial transfer is possible anyway. However, it is preferable to apply the voltage application pattern to all the pixel electrodes in the display region 40.

Moreover, although the pixel electrodes 9 to which a voltage above a threshold voltage required for transfer to the bend alignment in the transfer mode is applied may be a portion of the display region 40, it is preferable that they are entire the display region 40.

What is claimed is:

1. An OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display, the plurality of pixel electrodes including:

an arbitrary first row including a plurality of arbitrary first row pixel electrodes;

an arbitrary second row including at least a first arbitrary second row pixel electrode, a second arbitrary second row pixel electrode adjacent to the first arbitrary second row pixel electrode, and a third arbitrary second row pixel electrode adjacent to the first arbitrary second row pixel electrode, the first arbitrary second row pixel electrode disposed between the second arbitrary second row pixel electrode and the third arbitrary second row pixel electrode; and the arbitrary first row being adjacent to the arbitrary second row in a column direction, during the transfer, a voltage application operation applies an equal voltage to the plurality of arbitrary first row pixel electrodes, and applies a voltage to the first arbitrary second row pixel electrode higher than an applied voltage to the second arbitrary second row pixel electrode and the third arbitrary second row pixel electrode, and differences between at least some of voltages applied in the voltage application operation and the voltage of an electrode formed in the other substrate of the pair of substrates being more than a threshold voltage required for the transfer to the bend alignment from the spray alignment.

2. The liquid crystal device according to claim 1, in the voltage application operation, voltages having reverse polarities with respect to a predetermined reference potential being applied to the pixel electrodes in the first row and the pixel electrodes in the second row, and the polarity of a voltage applied to the pixel electrodes in each row being reversed for every unit time.

3. The liquid crystal device according to claim 1, in the voltage application operation, voltages having the same polarity with respect to a predetermined reference potential being applied to the pixel electrodes in the first row and the pixel electrodes in the second row, and the polarity of a voltage applied to the pixel electrodes in each row being reversed for every unit time.

4. The liquid crystal device according to claim 1, a voltage according to a gray-scale with respect to a predetermined reference potential being applied to each of the plurality of pixel electrodes after the voltage application operation during the transfer.

5. The liquid crystal device according to claim 1, all the voltages applied in the voltage application operation being more than the threshold voltage.

6. The liquid crystal device according to claim 1, the voltage application operation being performed on all the plurality of pixel electrodes in the display region.

7. An OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display, during the transfer, a voltage application operation applies an equal voltage to a plurality of pixel electrodes in an arbitrary first row, and applies voltages to a second row adjacent to the first row in a column direction such that pixel electrodes each having an equipotential line which goes around itself appear alternately being performed on a plurality of pixel electrodes corresponding to at least a portion of a display region, and differences between at least some of voltages applied in the voltage application operation and the voltage of an electrode formed in the other substrate of the pair of substrates being more than a threshold voltage required for the transfer to the bend alignment from the spray alignment.

8. The liquid crystal device according to claim 1, the voltage between at least a set of pixel electrodes generating a region in which the rotating directions of the liquid crystal molecules differ from each other, and causing disclination at a boundary between the regions.

9. A method of driving an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display, the plurality of pixel electrodes including:

an arbitrary first row including a plurality of arbitrary first row pixel electrodes;

an arbitrary second row including at least a first arbitrary second row pixel electrode, a second arbitrary second row pixel electrode adjacent to the first arbitrary second row pixel electrode, and a third arbitrary second row pixel electrode adjacent to the first arbitrary second row pixel electrode, the first arbitrary second row pixel electrode disposed between the second arbitrary second row pixel electrode and the third arbitrary second row pixel electrode; and the arbitrary first row being adjacent to the arbitrary second row in a column direction, during the transfer, a voltage application operation of applies an equal voltage to the plurality of arbitrary first row pixel electrodes, and applies a voltage to the first arbitrary second row pixel electrode higher than an applied voltage to the second arbitrary second row pixel electrode and the third arbitrary second row pixel electrode, and differences between at least some of voltages applied in the voltage application operation and the voltage of an electrode formed in the other substrate of the pair of substrates being set to be more than a threshold voltage required for the transfer to the bend alignment from the spray alignment.

10. The method of driving the liquid crystal device according to claim 9, the voltage between at least a set of pixel electrodes generating a region in which the rotating directions of the liquid crystal molecules differ from each other, and causing disclination at a boundary between the regions.

11. A display device comprising the liquid crystal device according to claim 1.

12. An OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display, the plurality of pixel electrodes including:

an arbitrary first row including a plurality of arbitrary first row pixel electrodes;

an arbitrary second row including at least a first arbitrary second row pixel electrode, a second arbitrary second row pixel electrode adjacent to the first arbitrary second row pixel electrode, and a third arbitrary second row pixel electrode adjacent to the first arbitrary second row pixel electrode, the first arbitrary second row pixel electrode disposed between the second arbitrary second row pixel electrode and the third arbitrary second row pixel electrode; and the arbitrary first row being adjacent to the arbitrary second row in a column direction, during the transfer, a voltage application operation applies an equal voltage to the plurality of arbitrary first row pixel electrodes, and applies a voltage to the first arbitrary second row pixel electrode lower than an applied voltage to the second arbitrary second row pixel electrode and the third arbitrary second row pixel electrode, and differences between at least some of voltages applied in the voltage application operation and the voltage of an electrode formed in the other substrate of the pair of substrates being more than a threshold voltage required for the transfer to the bend alignment from the spray alignment.

13. A method of driving an OCB-mode liquid crystal device including a plurality of pixel electrodes arranged in a matrix on one substrate of a pair of substrates, and transferring an aligned state of liquid crystal sandwiched between the pair of substrates from spray alignment in an initial state to bend alignment to perform display, the plurality of pixel electrodes including:

an arbitrary first row including a plurality of arbitrary first row pixel electrodes;

an arbitrary second row including at least a first arbitrary second row pixel electrode, a second arbitrary second row pixel electrode adjacent to the first arbitrary second row pixel electrode, and a third arbitrary second row pixel electrode adjacent to the first arbitrary second row pixel electrode, the first arbitrary second row pixel electrode disposed between the second arbitrary second row pixel electrode and the third arbitrary second row pixel electrode; and the arbitrary first row being adjacent to the arbitrary second row in a column direction, during the transfer, a voltage application operation applies an equal voltage to the plurality of arbitrary first row pixel electrodes, and applies a voltage to the first arbitrary second row pixel electrode lower than an applied voltage to the second arbitrary second row pixel electrode and the third arbitrary second row pixel electrode, and differences between at least some of voltages applied in the voltage application operation and the voltage of an electrode formed in the other substrate of the pair of substrates being set to be more than a threshold voltage required for the transfer to the bend alignment from the spray alignment.

* * * * *